US007498113B2

(12) United States Patent
Matsumura et al.

(10) Patent No.: US 7,498,113 B2
(45) Date of Patent: Mar. 3, 2009

(54) TONER FOR DEVELOPING ELECTROSTATIC IMAGE, PRODUCTION METHOD THEREOF, RESIN PARTICLE DISPERSION, AND ELECTROSTATIC IMAGE DEVELOPER

(75) Inventors: Yasuo Matsumura, Minamiashigara (JP); Takashi Imai, Minamiashigara (JP); Katsumi Daimon, Minamiashigara (JP); Shuji Sato, Minamiashigara (JP); Yusuke Ikeda, Minamiashigara (JP); Yosuke Tsurumi, Minamiashigara (JP); Hiroshi Nakazawa, Minamiashigara (JP); Kazufumi Tomita, Minamiashigara (JP); Shigeru Hayashi, Minamiashigara (JP); Moegi Iguchi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 510 days.

(21) Appl. No.: 11/244,055

(22) Filed: Oct. 6, 2005

(65) Prior Publication Data

US 2006/0240353 A1 Oct. 26, 2006

(30) Foreign Application Priority Data

Apr. 22, 2005 (JP) ..... 2005-125275
Jun. 27, 2005 (JP) ..... 2005-187456

(51) Int. Cl.
*G03G 9/00* (2006.01)

(52) U.S. Cl. ..... 430/109.4; 430/109.1

(58) Field of Classification Search ..... 430/109.4, 430/109.1

See application file for complete search history.

(56) References Cited

U.S. PATENT DOCUMENTS 5,342,724 A * 8/1994 Wilson ..... 430/114

FOREIGN PATENT DOCUMENTS

| | | |
|---|---|---|
| JP | A-63-282752 | 11/1988 |
| JP | A-01-163756 | 6/1989 |
| JP | A-02-079860 | 3/1990 |
| JP | A-04-081770 | 3/1992 |
| JP | A-04-107567 | 4/1992 |
| JP | B2-4-24702 | 4/1992 |
| JP | A-04-155351 | 5/1992 |
| JP | A-06-250439 | 9/1994 |
| JP | A-08-114942 | 5/1996 |
| JP | A-09-329917 | 12/1997 |
| JP | A-2002-351140 | 12/2002 |

* cited by examiner

*Primary Examiner*—Mark A Chapman
(74) *Attorney, Agent, or Firm*—Oliff & Berridge, PLC

(57) ABSTRACT

Provided are a toner for developing an electrostatic image comprising a crystalline resin having an ester bond and at least one of a sulfide bond or a disulfide bond in the main-chain, an electrostatic image developer and an image-forming process by using the same, a method of producing the toner for developing electrostatic image, and a resin particle dispersion using the same.

18 Claims, No Drawings

TONER FOR DEVELOPING ELECTROSTATIC IMAGE, PRODUCTION METHOD THEREOF, RESIN PARTICLE DISPERSION, AND ELECTROSTATIC IMAGE DEVELOPER

CROSS-REFERENCE TO RELATED APPLICATION

This application claims priority under 35 USC 119 from Japanese Patent Application Nos. 2005-125275 and 2005-187456, the disclosures of which are incorporated by reference herein.

BACKGROUND OF THE INVENTION

1. Field of the Invention

The present invention relates to a toner for developing an electrostatic image for use in developing an electrostatic latent image formed by an electrophotographic, electrostatic, or other recording process, a production method thereof, a resin particle dispersion for use in production of the toner, and an electrostatic image developer containing the toner.

2. Description on the Related Art

Methods such as electrophotographic processes and others that visualize image information through electrostatically charged images are currently used in a variety of fields. In an electrophotographic process, an image is visualized by forming an electrostatically charged image on a photoreceptor in electrostatic charging and photoexposing steps, developing the electrostatic latent image formed thereon with a developer containing a toner, and processing additionally through image-transferring and fusing steps to visualize the image. There are two kinds of developers for use in such systems: two-component developers consisting of a toner and a carrier and one-component developers employing only one magnetic or nonmagnetic toner. A kneading-pulverizing process, wherein a thermoplastic resin is melted and kneaded with a pigment, a charge controlling agent, and a releasing agent such as a wax or the like, and the resulting mixture is pulverized and classified after cooling, is commonly used as the method for producing toners. Inorganic or organic particles may be added to the toner if needed as an additive to the toner particle surface for improvement in fluidity and cleanability.

Recently, copying machines and printers using color electrophotographic methods and multifunctional processing machines containing such devices and facsimiles are becoming increasingly popular, but it is generally difficult to use a releasing agent such as wax or the like, for obtaining a suitable level of glossiness of image during reproduction of color image and an excellent transparency when forming an OHP image. For this reason, a great amount of oil is applied onto the fusing roll for facilitating exfoliation, and it becomes difficult to prevent a sticky feeling on the reproduced image, including the images on OHP sheets and to write additional characters or images onto the reproduced image, for example, with a pen or the like. In addition, the use of oil often results in uneven glossiness of the reproduced image. It is more difficult to use commonly-used waxes, such as polyethylene, polypropylene, or paraffin in normal black-and-white copying machines, because the wax impairs the transparency of the resulting OHP images.

As advances in digitalization and high-level image-processing technology proceed, there exists a need for advanced methods for improving image quality further, and in particular, an urgent need for improvement in color image quality, accompanies the rapid popularization of color image-processing machines.

Even if transparency is neglected, it is difficult, for example, to suppress exposure of wax on the toner surface in the method for producing toner in the conventional blending and pulverizing process, and thus such a toner shows marked deterioration in fluidity and causes filming on the developing machine or the photoreceptor when used.

As a basic method of overcoming these problems, a polymerization production process of controlling the exposure of wax on the surface by enclosing it inside toner is proposed, specifically, a method of producing a toner by direct polymerization of a dispersion prepared by dispersing an organic phase containing raw resin monomers and a colorant in an aqueous phase.

Alternatively, methods of producing a toner by an emulsification-polymerization flocculation method are also proposed as means of enabling deliberate control of the shape and surface structure of the toner (Japanese Patent Application Laid-Open (JP-A) Nos. 63-282752 and 6-250439). These are generally processes of producing a toner by mixing a resin particle dispersion prepared, for example, by emulsion polymerization with a colorant particle dispersion containing a colorant dispersed in a solvent, forming aggregates having a diameter similar to that of the toner particle, and fusing the agglomerates by heating.

These production processes allow not only enclosure of wax, but also easier reduction in the size of toner and thus images higher in sharpness and resolution.

As described above, for providing a high-quality image in the electrophotographic process and stabilized performance of toner under various mechanical stresses, it is quite important to optimize the kind and amount of pigment and releasing agent used, inhibit exposure of the releasing agent on the surface, improve the glossiness of printed images by optimizing the resin properties and the releasing property without using fusing oil, and control hot offsetting.

Alternatively, there is also a strong demand for reduction in energy consumption from the environmental point of view, and low-temperature fusing, i.e., image fusing at a lower temperature, is desirable for reduction in the energy consumption of copying machines and printers.

In the methods of performing low-temperature fusing with a toner, resins having a lower glass transition point are generally used as the toner binder resins. However, although a toner from the binder resins having a lower glass transition point is superior in low-temperature fusing efficiency, it is markedly poor in toner stability including toner storage stability, cohesion within the developing machine, and adhesiveness. In addition, the image forming film affixed, for example, on paper is fragile and causes defects easily by abrasion.

Methods of using a crystalline resin are also proposed as the means for achieving the low-temperature fusing (see, for example, Japanese Patent Application Publication (JP-B) No. 4-24702 and Japanese Patent Application Laid-Open (JP-A) No. 9-329917). These methods enable reduction of the fusing temperature, but cause a problem in that it is difficult to obtain a uniform and high-density image because of penetration of the toner fused during fusing into the paper.

Alternatively proposed are numerous methods of using a crystalline resin and an amorphous resin in combination, not of using a crystalline resin alone, as the binder resin (see, for example, JP-A No. 2-79860). Also disclosed are methods of using a polymer prepared by chemically binding a crystalline resin to an amorphous resin (see, for example, JP-A Nos. I-163756, 4-81770, and 4-155351). However, when there is more amorphous resin present than crystalline resin, the amorphous resin represents the continuous phase while the crystalline resin represents the dispersion phase; and in such a case, the melting point of the entire toner is dependent on the softening temperature of the amorphous resin, making low-temperature fusing difficult. Use of a crystalline resin higher in plasticity with an amorphous resin for low-temperature fusing results in deterioration in toner stability similar to when a resin having a lower glass transition point is used as the toner binder resin, decreasing the strength of image film and causing stains and defects by abrasion in the image film.

Conversely, if there is more crystalline resin present than amorphous resin, it is not possible to obtain the advantageous effects of the additional use of an amorphous resin.

Also proposed for low-temperature fusing are methods of using a wax having a low-melting point (see, for example, JP-A Nos. 4-107567 and 8-114942). These methods, which provide a releasing property by using a wax as a releasing agent and allowing release of the wax melted during fusion onto the image surface, often result in offsetting due to a decrease in the melt viscosity of the wax, and are effective only at a temperature sufficiently higher than the melting point of the wax. In addition, the release of wax is dependent on the compatibility between the binder resin and the wax as well as the melt viscosity of the binder resin, and thus, these methods are still unsatisfactory as means for achieving low-temperature fusing.

Especially in recent years, it is desired that power supply to a fusing device be controlled in the standby mode for thorough energy-conservation. Thus, it is necessary to raise the temperature of a fusing device instantaneously from the stand-by mode to a temperature that allows fusing by increasing the power supply to the fusing device before starting image fusing.

It is desirable to reduce the heat capacity of a fusing device to the minimum for that purpose, but in such a case, a fluctuation in the temperature of the fusing device may be expanded to a range larger than before. In other words, the overshoot of the temperature of the fusing device immediately after power is supplied is increased, and the decrease in temperature by the passage of paper is also enhanced. If paper smaller in width than that of the fusing device is fed repeatedly, the difference between the temperatures in the paper-passing and non-passing areas becomes enlarged. In particular, high-speed copying machines and printers, which do not have a sufficiently large electrical capacity have a strong tendency towards the phenomena described above when the heat capacity is reduced. Accordingly, there exists a strong need for a so-called wide fusing-latitude electrophotographic toner that can be fixed at a low temperature and does not cause offsetting even at a temperature in a higher temperature range.

Use of a crystalline poly-condensation resin that exhibits a sharper melting behavior with respect to temperature as the binder resin for toner is known to be effective for lowering the fusing temperature of toner. However, crystalline resins are more resistant to pulverization in the melt-kneading pulverization process and thus often cannot be used.

If a crystalline resin prepared by poly-condensation is used as the binder resin, a reaction demanding stirring at high power at a high temperature of more than 200° C. under an extremely low pressure over a period of 10 hours or more is needed for polymerization, which results in a great amount of energy consumption. In addition, such a resin production facility often demands increased durability and thus a vast amount of facility investment.

As described above, when a toner is produced by the emulsion polymerization aggregation method, the toner may be produced by producing a crystalline poly-condensation resin by polymerization, converting it into a latex by emulsifying the resin or aforementioned compound in an aqueous medium, mixing and coagulating it with a pigment, a wax, and the like, and fusing the resulting aggregates.

However, this method requires an extremely inefficient and energy-consuming step, for example, of emulsifying the poly-condensation resin under high shearing force at a high temperature exceeding 150° C., or dispersing a low-viscosity solution of the resin in an aqueous medium, and then removing the solvent.

Because of the difficulty in avoiding the problem of hydrolysis during emulsification in an aqueous medium, there are always uncertainties in material design being inevitably generated.

Although these problems are more obvious during use of crystalline resins, the same problems occur not only during use of the crystalline resins but also during use of non-crystalline resins.

For example, a method is proposed of producing a toner by forming a fused raw toner by heating and melting the raw toner materials containing at least a polyester resin, forming resin particles by emulsifying the fused toner in an aqueous medium, and aggregating and then fusing the resin particles together with other components (JP-A No. 2002-351140).

When producing a toner according to this method, the binder resin is prepared and emulsified, for example, as follows: First, a polyester having a weight-average molecular weight of approximately 5,000 to 90,000 is prepared by using a conventional poly-condensation catalyst such as tetrabutyl titanate, trimellitic anhydride (TMA) as polyvalent carboxylic acid monomer, terephthalic acid (TPA) and isophthalic acid (IPA) as bivalent carboxylic acid monomers, polyoxypropylene (2.4)-2,2-bis(4-hydroxyphenyl) propane (BPA-PO) and polyoxyethylene (2.4)-2,2-bis(4-hydroxyphenyl) propane (BPA-EO) as aromatic diol monomers, and ethylene glycol (EG) as an aliphatic diol monomer; allowing the raw materials above to react with each other at 220° C. under high atmospheric pressure and a nitrogen stream for 15 hours; and continuing the reaction at a gradually reduced pressure and finally at a pressure of 10 mm Hg.

Then, this polyester is melted and kneaded with colorant, wax and the like. The resulting mixture is heated to 190° C., and placed in a Cavitron CD1010 dispersion emulsifier (Eurotec, Ltd.). A 0.5 wt % dilute ammonia water is heated to 160° C. with a heat exchanger, and introduced into the Cavitron at a rate of 1 L per minute. After dispersion processing is done, the mixture is cooled to 60° C. to obtain a resin particle dispersion.

For preparation of a toner, the dispersion is further aggregated, fused, washed and dried. Such a method demands a vast amount of energy in the resin production and emulsification processes.

A crystalline resin prepared by poly-condensation exhibits a sharp-melting behavior with respect to temperature and is thus effective for the purpose of low-temperature fusing. On the other hand, amorphous resins are occasionally superior in mechanical strength and consistency of electrostatic properties of the toner when used for an extended period of time.

Accordingly, it is important to improve both the low-temperature fusing efficiency and the reliability of toner when used for an extended period of time, by using not only a crystalline resin but also a non-crystalline resin on the surface of or inside the toner.

In particular, low temperature-fusing toners often cause filming on the photoreceptor and have difficulty in preserving image quality because of a deterioration in charging properties as a developer when used continuously in a summertime environment.

In this case, a commonly used method of preparing toner is mixing, aggregating, and fusing the crystalline resin particle dispersion and non-crystalline resin particle dispersion in water. However, because the thermal fusion characteristics of each resin particle greatly differs in this case, a variation in adhesive strength between particles is generated sometimes resulting in uneven particle distribution during aggregation; and even if toner successfully prepared, the toner's low-temperature fusing properties and charging properties over time are sometimes insufficient because resin particles inside and on the surface of the toner are not distributed as expected.

SUMMARY OF THE INVENTION

The objects above are achieved by the following invention. Namely, the invention comprises of:

<1> A toner for developing an electrostatic image, comprising a crystalline resin having an ester bond and at least one of a sulfide bond or a disulfide bond in the main-chain.

<2> The toner for developing an electrostatic image of <1>, wherein the melting point of the crystalline resin is in the range of 45 to 75° C.

<3> The toner for developing an electrostatic image of <1>, further comprising an amorphous resin.

<4> The toner for developing an electrostatic image of <3>, wherein the crystalline resin is contained in an amount in the range of 5 to 30 wt % with respect to the amorphous resin.

<5> The toner for developing an electrostatic image of <3>, wherein the crystalline resin has a glass transition temperature in a range of 50 to 75° C.

<6> The toner for developing an electrostatic image of <1>, wherein the toner has a cumulative volume-average particle diameter $D_{50v}$ in a range of 3.0 to 5.0 μm.

<7> The toner for developing an electrostatic image of <1>, prepared in an aggregation step of preparing aggregate particles by aggregating raw particles in a raw material dispersion in which raw material particles containing crystalline resin particles of a crystalline resin having an ester bond and at least one of a sulfide bond or a disulfide bond in the main-chain are dissolved, and a subsequent coalescence step of heating the aggregate particles, the crystalline resin particles, comprising:

(1) crystalline resin particles prepared in a polymerization step of preparing the crystalline resin by poly-condensing poly-condensation monomers in a non-aqueous medium by using a surface-active acid as a poly-condensation catalyst, and in a subsequent emulsification step of dispersing the crystalline resin obtained in the polymerization step in an aqueous medium; and/or (2) crystalline resin particles prepared in an emulsification polymerization step of preparing the crystalline resin by poly-condensing poly-condensation monomers in an aqueous medium using a surface-active acid as the poly-condensation catalyst, and dispersing the crystalline resin thus prepared in the aqueous medium.

<8> The toner for developing an electrostatic image of <7>, wherein the crystalline resin particles have median particle size in a range of 0.05 to 2.0 μm.

<9> A method of producing the toner for developing an electrostatic image of <1>, comprising:

an aggregation step of preparing aggregate particles by aggregating raw material particles in a raw material dispersion in which raw material particles containing crystalline resin particles of a crystalline resin having an ester bond and at least one of a sulfide bond or a disulfide bond in the main-chain are dissolved, and a subsequent coalescence step of heating and fusing the aggregate particles, wherein the crystalline resin particles comprise:

(1) crystalline resin particles prepared in a polymerization step of preparing the crystalline resin by poly-condensing poly-condensation monomers in a non-aqueous medium by using a surface-active acid as poly-condensation catalyst, and in a subsequent emulsification step of dispersing the crystalline resin obtained in the polymerization step in an aqueous medium; and/or (2) crystalline resin particles prepared in an emulsification polymerization step of preparing the crystalline resin by poly-condensing poly-condensation monomers in an aqueous medium by using a surface-active acid as the poly-condensation catalyst and dispersing the crystalline resin thus prepared in the aqueous medium.

<10> The method of producing a toner for developing an electrostatic image of <9>, wherein the crystalline resin particles have median particle size in a range of 0.05 to 2.0 μm.

<11> A method of producing the toner for developing an electrostatic image of <1>, the methods comprising:

a polymerization step of preparing the crystalline resin by poly-condensing poly-condensation monomers in a non-aqueous medium using a surface-active acid as the poly-condensation catalyst; and an emulsification step of dispersing the crystalline resin obtained in the polymerization step in an aqueous medium.

<12> A resin particle dispersion prepared by adding a base to the aqueous medium which disperses the crystalline resin produced by the method of <11>, wherein the crystalline resin particles containing of the crystalline resin have a median particle size in a range of 0.05 to 2.0 μm.

<13> A method of producing the toner for developing an electrostatic image of <1>, the method comprising:

an emulsification polymerization step of preparing the crystalline resin by poly-condensing poly-condensation monomers in an aqueous medium using a surface-active acid as the poly-condensation catalyst and dispersing the crystalline resin thus prepared in the aqueous medium.

<14> A resin particle dispersion prepared by adding a base to the aqueous medium which disperses the crystalline resin produced by the method of <13>, wherein the crystalline resin particles containing the crystalline resin have a median particle size in a range of 0.05 to 2.0 μm.

<15> An electrostatic image developer, comprising a toner for developing an electrostatic image which contains a crystalline resin having an ester bond and at least one of a sulfide bond or a disulfide bond in the main-chain.

DETAILED DESCRIPTION OF THE INVENTION

The invention provides an electrostatic developing toner superior all in low-temperature fusing efficiency, electrostatic properties and storage stability as well as reliability to the toners using a conventional crystalline resin, an electrostatic image developer, and a method of producing the electrostatic developing toner and a resin particle dispersion for use therein.

In addition in an embodiment, the invention provides a toner for developing electrostatic latent image superior in low-temperature fusing efficiency and the strength of fixed image under high-temperature and high-humidity condition.

Electrostatic Developing Toner

The electrostatic developing toner according to the invention (hereinafter, may be may be referred to as "toner") characteristically contains a crystalline resin having an ester bond and at least one of a sulfide bond or a disulfide bond in the main-chain (hereinafter, may be referred to as "crystalline polysulfide ester resin").

The crystalline polysulfide ester resin for use in the invention contains not only an ester bond but also a sulfide bond or a disulfide bond in the main-chain (hereinafter, the structure containing both bonds is may be referred as a "sulfur-containing structure") similarly to the crystalline polyesters commonly used hitherto as the crystalline resins for toner.

Thus, the toner according to the invention has a low-temperature fusing property, similarly to the conventional toners of crystalline polyesters. In addition, the toner is superior both in electrostatic properties and storage stabilities (of toner and image) to the conventional toners of crystalline polyesters. Consequently, the toner is significantly improved in the reliability, for example consistency in image quality, during continuous printing, in image forming in the electrophotographic process. Such improvement seems to be the results of the sulfur-containing structure present in the main-chain. Typical examples of the molecular structures of the crystalline polysulfide ester resin are listed below:

$$—(C(O)—R1\text{-}S—R2\text{-}C(O)—O—R3\text{-}O)_n— \quad \text{Formula (1)}$$

$$—(C(O)—R1\text{-}S—S—R2\text{-}C(O)—O—R3\text{-}O)_n— \quad \text{Formula (2)}$$

$$—(C(O)—R1\text{-}C(O)—O—R2\text{-}S—R3\text{-}O)_n— \quad \text{Formula (3)}$$

$$—(C(O)—R1\text{-}C(O)—O—R2\text{-}S—S—R3\text{-}O)_n— \quad \text{Formula (4)}$$

$$—(C(O)—R1\text{-}S—R2\text{-}C(O)—O—R3\text{-}S—R4\text{-}O)_n— \quad \text{Formula (5)}$$

$$—(C(O)—R1\text{-}S—S—R2\text{-}C(O)—O—R3\text{-}S—R4\text{-}O)_n— \quad \text{Formula (6)}$$

$$—(C(O)—R1\text{-}S—R2\text{-}C(O)—O—R3\text{-}S—S—R4\text{-}O)_n— \quad \text{Formula (7)}$$

$$—(C(O)—R1\text{-}S—S—R2\text{-}C(O)—O—R3\text{-}S—S—R4\text{-}O)_n— \quad \text{Formula (8)}$$

In Formulae (1) to (8), R1, R2, R3, and R4 each represent an aliphatic, aromatic or alicyclic hydrocarbon group or a group in combination of these groups; and n is an integer.

The action mechanism of the sulfur-containing structure in the main-chain is still not always clear; the sulfur-containing structure has an aggregation energy per group almost at the middle of those of an alkyl group and an ester group, typical partial structures of the main chain, and thus, the sulfur-containing structure seems to be the reason for giving the resin a suitable toughness and a reduced environmental dependence, for example in the amount of electrostatic charge, compared to when only an ester structure is included as a characteristic structure in the main chain.

Thus, it is possible use a crystalline polysulfide ester resin according to the invention having a melting point lower by approximately 5° C. than those of the crystalline polyester resins hitherto used as toner binder resins (melting point: 50 to 80° C.) if it has similar electrostatic properties and storage stability, and the reduction in melting point is equivalent to a reduction in fusing temperature of 10 to 15° C.

From the viewpoints above, the crystalline polysulfide ester resin for use in the invention preferably has a melting point in the range of 45 to 75° C. and more preferably in the range 50 to 70° C. A melting point of lower than 45° C., which is excessively lower, may deteriorate the storage stability of toner and image in high-temperature environment. On the other hand, a melting point of higher than 75° C. may result in a smaller difference in properties such as low-temperature fusing efficiency, electrostatic properties and storage stability from those of the conventional crystalline polyester resins, and thus, there may be less advantageous in using the toner according to the invention.

On the other hand, conventional crystalline polyester resins are materials essential for low-temperature fusing but are insufficient in electrostatic properties and storage stability as they are, and thus, should be used in combination with an amorphous resin. In addition, a toner should have a so-called core shell structure consisting of a core layer containing a crystalline polyester resin and a shell layer containing an amorphous resin, leading to a certain restriction on the material and structure of the toner used in combination with a crystalline polyester resin and a lowered degree of freedom in toner design.

In contrast, the toner according to the invention eliminates the need for a core shell structure because of the superior low-temperature fusing efficiency, electrostatic properties and storage stability thereof in a practical range, even when the binder resin is made of the above-described crystalline polysulfide ester resin, and provides a higher degree of freedom in design because there is no need for using an amorphous resin in combination. Accordingly, the toner can be prepared in more diversified or simpler processes and possibly allows reduction in cost.

After intensive studies, the inventors have found that crystalline polysulfide ester resins tend to exhibit a reversible plasticization action with respect to temperature when mixed with an amorphous resin. The fact means that a toner in combination of an amorphous resin having a higher glass transition temperature and a crystalline polysulfide ester resin may be more resistant to deterioration at the low-temperature fusing efficiency and more favorable in the storage stability of toner and image than conventional toners in combination of a crystalline polyester resin and an amorphous resin (glass transition temperature: approximately 45 to 70° C.).

From the viewpoints above, if a crystalline polysulfide ester resin and an amorphous resin are used in combination, the glass transition temperature of the amorphous resin is preferably in the range of 50 to 75° C., which is higher approximately by 5° C. than before, and more preferably in the range of 60 to 70° C. An excessively high glass transition temperature exceeding 75° C. may damage the low-temperature fusing efficiency. Alternatively, a glass transition temperature of lower than 55° C. may result in increase of hot offsetting during fixation.

When a crystalline polysulfide ester resin and an amorphous resin are used together, the crystalline polysulfide ester resin is preferably contained in an amount of 5 to 30 wt %, more preferably 10 to 25 wt %, with respect to the amorphous resin. A content of less than 5 wt % may result in decrease in the plasticization action of the amorphous resin and deterioration in low-temperature fusing efficiency. Alternatively, a content of more than 30 wt % may lead to saturation of the plasticization action, resulting in decrease of the difference in storage stability from the case when a crystalline polysulfide ester resin is used as the principal component of binder resin.

On the other hand, a crystalline polysulfide ester resin and an amorphous resin are preferably present in toner as they are mixed for obtaining more effective plasticization action. For example, when the toner according to the invention has a so-called core shell structure consisting of a core layer and a shell layer enclosing the core layer, it is possible to exhibit an plasticization action in the region close to the interface between the core and shell layers by using a combination of a crystalline polysulfide ester resin as the core-layer binder resin and an amorphous resin as the shell-layer binder resin, but it is more preferable to use a mixture of a crystalline polysulfide ester resin and an amorphous resin as the core-layer binder resin and an amorphous resin as the shell-layer binder resin.

As described above, the toner according to the invention provides a low-temperature fusing efficiency, electrostatic properties and a storage stability at levels higher than those of the conventional toners, but it is preferable to use a crystalline polysulfide ester resin entirely or mainly as the binder resin for improvement in low-temperature fusing efficiency or simplification of the toner manufacturing process and to use a crystalline polysulfide ester resin and a amorphous resin in combination for further improvement in storage stability.

In an embodiment of the invention, the toner for developing electrostatic latent image is a toner for developing electrostatic latent image containing a crystalline resin, a binder resin, and a colorant, in which the crystalline resin used is an ester compound prepared by reacting a sulfur atom-containing dicarboxylic acid with an aliphatic dialcohol having an even number of carbons (hereinafter, may be referred to as "first ester compound") or an ester compound prepared by reacting a sulfur atom-containing dialcohol with a fatty dicarboxylic acid having an even number of carbons (hereinafter, may be referred to as "second ester compound"). The weight-average molecular weight of each of the first and second ester compounds is 5,000 to 12,000.

Both of the first and second ester compounds have a sulfur atom and a thioether structure in the molecule. The toner for developing electrostatic image according to the invention containing an ester compound having a thioether structure is superior to conventional crystalline polyesters both in low-temperature fusing efficiency and electrostatic properties. In particular, introduction of the thioether structure reduces the environmental dependence on a simple ester group having the same level of plasticity. However, the sulfur atom in the molecule inhibits crystallization more than a carbon atom and gives a crystal lower in density. The crystalline compound having a thioether structure is known to show thermal reversibility when mixed with an amorphous resin, and thus, it is possible to obtain an image less plastic and higher in image intensity after fusion. In addition, the first and second ester compounds according to the invention, which use respectively monomers having an even number of carbons as the non-sulfur atom-containing monomers (aliphatic dialcohol for the first ester compound and fatty dicarboxylic acid for the second ester compound), give crystals higher in density and thus images higher in strength.

Crystalline Polysulfide Ester Resin and Resin Dispersion Using the Same

Hereinafter, a method of producing the crystalline polysulfide ester resin for use in the invention will be described.

The crystalline polysulfide ester resin can be produced, for example, in a step of poly-condensing poly-condensation monomers in a non-aqueous or aqueous medium by using a surface-active acid as poly-condensation catalyst. Specifically, it is prepared by mixing and melting poly-condensation monomers and a surface-active acid, heating the mixture to a particular temperature under atmospheric or reduced pressure, and stirring the mixture at the same temperature. Another poly-condensation catalyst or surfactant may be used additionally as needed during the preparation.

If the toner according to the invention is prepared by using an emulsion-polymerization flocculation process, the crystalline polysulfide ester resin for use in the invention is used in resin particle dispersion during preparation of the toner.

In such a case, the resin particle dispersion can be prepared by one of the following two production methods: (1) A resin particle dispersion containing crystalline polysulfide ester resin particles is prepared in a polymerization step of preparing the crystalline resin by poly-condensing poly-condensation monomers in the presence of a surface-active acid as poly-condensation catalyst but in the absence of water (in non-aqueous medium) and an emulsification step of dispersing the crystalline resin obtained in the polymerization step in an aqueous medium; or (2) A resin particle dispersion containing crystalline polysulfide ester resin particles is prepared in an emulsification polymerization step of preparing the crystalline resin by poly-condensing poly-condensation monomers in an aqueous medium by using a surface-active acid as the poly-condensation catalyst and dispersing the prepared crystalline resin in the aqueous medium.

Preferably, a base is added to the resin particle dispersion obtained after these steps, for neutralization of the acid catalyst used for poly-condensation such as a surface-active acid.

The resin particle dispersion used when the toner according to the invention is prepared in an emulsion-polymerization flocculation process preferably contains resin particles having an median diameter (mean diameter) in the range of 0.05 μm or more and 2.0 μm or less, more preferably 0.1 μm or more and 1.5 μm or less, and still more preferably 0.1 m or more and 1.0 μm or less.

When the median diameter is in the range above, the dispersion state of the resin particles in resin particle dispersion is stabilized.

An excessively smaller median diameter may lead to increase in aggregating tendency during dispersion of the particles, easier generation of free resin particles, as well as increase in viscosity of the reaction system, making it difficult to control the particle diameter. On the other hand, particles having an excessively large median diameter may lead to easier generation of coarse powder and expansion of the particle size distribution. When a releasing agent is used additionally, it may also lead to deterioration in the release property or decrease in the offsetting temperature during fusing, because the releasing agent is liberated more easily.

The median diameter of the resin particles in resin particle dispersion can be determined, for example, by using a laser-diffraction particle size distribution analyzer (LA-920, manufactured by Horiba, Ltd.).

In preparing the crystalline polysulfide ester resin particles, it is particularly preferable to use a surface-active acid as the poly-condensation catalyst, because use of it can reduce the energy consumption during toner production drastically. Use of a surface-active acid can lower the temperature during resin polymerization, from a temperature normally needed of 200° C. or higher to a temperature of 150° C. or lower or further of 100° C. or lower.

It is also possible to perform emulsification at a low temperature of 150° C. or lower when the resin particle dispersion is prepared, because the surface-active acid also functions as a dispersant for dispersing and emulsifying the resin.

Conventionally, a dispersant was often added to an aqueous medium when a resin is dispersed or emulsified in an aqueous medium, but in such a case, the resin could not be emulsified easily unless a high temperature causing decrease in the viscosity of the resin is applied to the aqueous medium, and thus, it was not possible to perform emulsification at low temperature.

Modification of the resin to make it more self-dispersible in water, for example addition of an acidic value for increase in the emulsification efficiency of resin as described in Japanese patent application laid-open (JP-A) No. 2002-351140, is not practical when the resin is used finally as toner, because the resin, which is more hydrophilic, leads to deterioration in electrostatic properties and drastic change in toner electrostatic properties under a high-temperature and high-humidity or low-temperature and low-humidity condition.

The surface-active acid used, which is a relatively small molecule and is highly soluble in water, is removed almost entirely when the resin prepared is washed during preparation of toner, and thus, it is possible to reduces the influence thereof on toner electrostatic properties to the minimum.

Application of a shearing force at high temperature often results in hydrolysis of the resin once poly-condensed and causes problems such as deterioration in toner electrostatic properties and fusing efficiency, but the dispersion emulsification at low temperature eliminates these problems.

As for the above-described resin particle dispersion, it is possible to obtain poly-condensation resin particles at low energy consumption by poly-condensing poly-condensation monomers at a low temperature of 150° C. or lower and emulsifying and dispersing the polymer at low temperature. In addition, the poly-condensation resin particles in an aqueous medium are obtained in the dispersion state in which the particles are separated from each other in water, or in the state stable for a long term before the aggregation operation for preparation of toner, for example, by using a coagulant; the resin particles give aggregate particles reliably, only by aggregation operation; and use of the resin particles allows improvement in the particle size distribution of toner, uniformization of the composition and structure of individual toner particles, and thus production of a toner satisfactory in toner properties.

The "surface-active acid" according to the invention is an acid having a chemical structure containing both hydrophobic and hydrophilic groups wherein at least part of the hydrophilic groups has a protonic acid structure, and specifically, a catalyst having an alkyl or alkylbenzene group as the hydrophobic group and a strong acid group such as sulfonic acid or sulfuric acid as the hydrophilic group, that functions as an emulsifier and a catalyst.

Examples of the surface-active acids include alkylbenzenesulfonic acids such as dodecylbenzenesulfonic acid, isopropylbenzenesulfonic acid, cerylbenzenesulfonic acid, and camphorsulfonic acid; alkylsulfuric acids, alkyl disulfonic acids, alkylphenolsulfonic acids, alkylnaphthalenesulfonic acids, alkyltetralinsulfonic acids, alkylallylsulfonic acids, petroleum sulfonic acid, alkylbenzimidazolesulfonic acids, higher alcohol ether sulfonic acids, alkyldiphenylsulfonic acids, monobutylphenylphenolsulfuric acid, dibutylphenylphenolsulfuric acid, higher fatty acid sulfate esters such as dodecylsulfuric acid, higher alcohol sulfate esters, higher alcohol ether sulfate esters, higher fatty acid amide alkylol sulfate esters, higher fatty acid amide alkylated sulfate esters, naphthenylalcohol sulfuric acid, sulfated fatty acids, sulfosuccinic acid esters, various fatty acids, sulfonated higher fatty acids, higher-alkylphosphoric acids ester, resin acids, resin acid alcohol sulfuric acids, naphthenic acid, paratoluenesulfonic acid, as well as the salts thereof. These compounds may be used in combination.

During preparation of the resin, any rare-earth metal-containing catalyst or hydrolytic enzyme may be used in addition to the surface-active acid as the poly-condensation catalyst.

Examples of the rare-earth metal-containing catalyst used additionally include compounds containing a lanthanoid element such as lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu); and in particular, alkylbenzenesulfonic acid salts, alkyl sulfate ester salts, and salts having a metal triflate structure are effective.

Examples of the metal triflates include those represented by the following Formula (9):

$$X(OSO_2CF_3)_3 \qquad \text{Formula (9)}$$

Among the metal triflates, those having scandium (Sc), yttrium (Y), ytterbium (Yb), samarium (Sm) and the like as X are preferable.

Preferable as other rare-earth metal-containing catalysts are lanthanoid triflates and the like. The lanthanoid triflates for use include those described, for example, in J. Soc. Syn. Org. Chem., 53 (5), pp. 44-54.

The hydrolytic enzyme used additionally is not particularly limited, if it catalyzes the ester synthesis reaction.

Example of hydrolytic enzymes include the esterase included in EC (enzyme number) 3.1 (see, Maruo and Tamiya Ed., "Enzyme Handbook", Asakura Publishing Company Ltd. (1982) and others) such as carboxy esterase, lipase, phospho lipase, acetyl esterase, pectin esterase, cholesterol esterase, tannase, monoacylglycerol lipase, lactonase, and lipopreotein lipase; the hydrolytic enzymes included in EC 3.2 such as glucosidase, galactosidase, glucuronidase, and xylosidase; the hydrolytic enzymes included in EC 3.3 such as epoxide hydrase; the hydrolytic enzymes acting on a peptide bond included in EC 3.4 such as aminopeptidase, chymotrypsin, trypsin, plasmin, and subtilisin; the hydrolytic enzymes included in EC 3.7 such as phloretin hydrase.

Among these esterases, enzymes hydrolyzing a glycerol ester and liberating a fatty acid are called lipase particularly, and the lipases are advantageous as they are more stable in an organic solvent, catalyze the ester synthesis reaction, and are available at lower cost. Thus, use of a lipase is preferably from the points of yield and cost in producing the crystalline polysulfide ester resin for use in the invention.

Preferable examples thereof include lipases from microbes such as Pseudomonas, Alcaligenes, Achromobacter, Candida, Aspergillus, Rhizopus, and Mucor; lipases from vegetable seeds; lipases from animal tissues; pancreatin, steapsin. Among them, lipases from the microbes of Pseudomonas, Candida, and Aspergillus species are preferably used. These poly-condensation catalysts may be used alone or in combination of two or more.

A polyvalent carboxylic acid having two or more carboxyl groups in a molecule and a polyvalent alcohol having two or more hydroxyl groups in a molecule are used as the polymerizable monomers for the crystalline polysulfide ester resin, and the polyvalent alcohol may be esterified. However, at least one of the polymerizable monomers should have a sulfide or disulfide bond.

Examples of the polyvalent carboxylic acids having a sulfide or disulfide bond include thiodicarboxylic acids, dithiodicarboxylic acids, and the esters thereof such as 3,3'-thiodipropionic acid (β,β'-thiodipropionic acid), thiodisuccinic acid, thiodibutyric acid, 3,3'-dithiodipropionic acid, 2,2'-dithiobenzoic acid, 2,2'-dithiodibutyric acid, 6,6'-dithiodinicotinic acid, 3,3'-dithiobis(2-aminopropionic acid), di-n-dodecyl 3,3'-thiodipropionate, di-2-ethylhexyl 3,3'-thiodipropionate, dimethyl 3,3'-dithiodipropionate, dioctadecyl 3,3'-thiodipropionate, di-n-tetradecyl 3,3'-thiodipropionate.

Examples of the polyvalent alcohols having a sulfide or disulfide bond include thiodialcohols, dithiodialcohols, and the esters thereof such as 2,2'-thiodiethanol, 4,4'-thiodiphenol, 3,3'-thiodipropanol, 2,2'-dithiodiethanol, 6,6'-dithiodi-2-naphtho 1.

Examples of the polyvalent carboxylic acids having no sulfide or disulfide bond include bivalent carboxylic acids having two carboxyl groups in a molecule such as oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid.

In addition, examples of the trivalent or higher polyvalent carboxylic acids include trimellitic acid, pyromellitic acid, naphthalenetricarboxylic acid, naphthalenetetracarboxylic acid, pyrenetricarboxylic acid, pyrenetetracarboxylic acid.

In particular among the polyvalent carboxylic acids, use of azelaic acid, sebacic acid, 1,9-nonanedicarboxylic acid, 1,10-decanedicarboxylic acid, 1,11-undecanedicarboxylic acid, 1,12-dodecanedicarboxylic acid, terephthalic acid, trimellitic acid, pyromellitic acid, or the like is preferable. Because these polyvalent carboxylic acids are hardly soluble in water or insoluble, the ester synthesis reaction proceeds in a suspension of the polyvalent carboxylic acid dispersed.

Examples of the polyvalent alcohols having no sulfide or disulfide bond include bivalent alcohols having two hydroxyl groups in a molecule such as ethylene glycol, propylene glycol, butanediol, diethylene glycol, hexanediol, cyclohexanediol, octanediol, decanediol, nonanediol, decanediol, dodecanediol.

Examples of the trivalent or higher polyvalent alcohols include glycerol, pentaerythritol, hexamethylol melamine, hexaethylol melamine, tetramethylol benzoguanamine, tetraethylol benzoguanamine.

In particular among the polyvalent alcohols, use of a bivalent polyvalent alcohol such as 1,8-octanediol, 1,10-decanediol, 1,12-dodecanediol is preferable. Because these polyvalent alcohols are hardly soluble in water or insoluble, the ester synthesis reaction proceeds in a suspension of the polyvalent alcohol dispersed.

It is possible to obtain a non-crystalline or crystalline polyester resin easily in combination of these poly-condensation monomers having no sulfide or disulfide bond and also to obtain a toner having desirable properties in combined used of these resins and the crystalline polysulfide ester resin described above. In addition, as will be described below, a polyamide in combination of polyvalent carboxylic acids and a polyamine may also be used together.

Examples of the polyvalent carboxylic acids used for obtaining the polyester resin include oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, as well as the acid anhydrides or acid chlorides thereof.

Examples of the polyvalent alcohols used for obtaining the polyester resin also include ethylene glycol, diethylene glycol, triethylene glycol, 1,2-propylene glycol, 1,3-propylene glycol, 1,4-butanediol, 1,4-butenediol, neopentylglycol, 1,5-pentane glycol, 1,6-hexane glycol, 1,4-cyclohexanediol, 1,4-cyclohexanedimethanol, dipropylene glycol, polyethylene glycol, polypropylene glycol, polytetramethylene glycol, bisphenol A, bisphenol Z, hydrogenated bisphenol A.

Example of the polyamines for use in combination with the above-described polyvalent carboxylic acid for obtaining the polyamide resin include ethylenediamine, diethylenediamine, triethylenediamine, 1,2-propylenediamine, 1,3-propylenediamine, 1,4-butanediamine, 1,4-butenediamine, 2,2-dimethyl-1,3-butanediamine, 1,5-pentanediamine, 1,6-hexanediamine, 1,4-cyclohexanediamine, 1,4-cyclohexanedimethylamine.

In the invention, the melting point of the crystalline resin can be determined as the peak melting temperature specified by JIS K-7121: 87 that is determined by using the input compensation differential scanning calorimeter (DSC) under the condition of a programmed heating rate of 10° C. per minute from room temperature to 150° C. If the crystalline resin shows multiple melting peaks in the measurement above, the maximum peak temperature is regarded as the melting point in the invention.

Alternatively, the glass transition temperature of the amorphous resin is a value as determined by the method (DSC method) specified by ASTM D3418-82.

The weight-average molecular weight of the binder resins such as the crystalline polysulfide ester resins for use in the invention is in the range of 1,500 to 60,000 and preferably 3,000 to 40,000. A weight-average molecular weight of less than 1,500 may lead to decrease in the aggregation force of binder resin and hot-offsetting property, while a weight-average molecular weight of more than 60,000 to increase in the lowest fusing temperature although the hot-offsetting property is favorable. The polyvalent carboxylic acid and the polyvalent alcohol for use as polymerizable monomers may be partially branched or cross-linked, depending on the valency of the monomer selected.

When the toner according to the invention is prepared in an emulsion-polymerization flocculation process, a resin particle dispersion containing binder resin particles dispersed is used, and in such a case, the particle diameter of the binder resin particles is preferably 10 μm or less as volume-average particle diameter and more preferably 7 μm or less, and the most preferable particle diameter is 1 μm or less.

A binder resin having a particle diameter of larger than 10 μm is not favorable from the point of the image-quality characteristics such as resolution of the toner during use. In addition, a binder resin having a particle diameter of larger than 10 μm may cause problems during production such as increase in molecular weight and decrease in polymerization rate during production thereof by poly-condensation as described above, and also problems in the image intensity after fixation.

During dispersion and emulsification of the binder resin obtained, for example, by the above-described poly-condensation in an aqueous medium, the materials above are emulsified or dispersed in an aqueous medium, for example, by using mechanical shear, ultrasonic wave, and it is possible to add a surfactant, a polymer dispersant, an inorganic dispersant, or the like to the aqueous medium as needed during the emulsification and dispersion.

Examples of the surfactants used there include anionic surfactants of sulfate ester salts, sulfonate salts, phosphate esters; cationic surfactants of amine salts, quaternary ammonium salts, and the like; nonionic surfactants of polyethylene glycol, alkylphenol ethylene oxide adducts, polyvalent alcohols, and the like.

Among them, anionic and cationic surfactants are preferable. The nonionic surfactant above is preferably used together with an anionic or cationic surfactant. The surfactants may be used alone or in combination of two or more.

Examples of the anionic surfactants include sodium dodecylbenzenesulfonate, sodium alkylnaphthalenesufonates, sodium arylalkylpolyethersulfonates, sodium 3,3-disulfonediphenylurea-4,4-diazo-bis-amino-8-naphtho 1-6-sulfonate, ortho-carboxybenzene-azo-dimethylaniline, sodium 2,2,5,5-tetramethyl-triphenylmethane-4,4-diazo-bis-β-naphthol-6-sulfonate, sodium dialkylsulfosuccinates, sodium dodecylsulfate, sodium tetradecylsulfate, sodium pentadecylsulfate, sodium octylsulfate, sodium oleate, sodium laurate, sodium caprate, sodium caprylate, sodium caproate, potassium stearate, calcium oleate.

Examples of the cationic surfactants include alkylbenzenedimethylammonium chlorides, alkyltrimethylammonium chlorides, distearylammonium chloride.

Examples of the nonionic surfactants include polyethylene oxide, polypropylene oxide, combinations of polyethylene oxide and polypropylene oxide, esters from polyethylene glycol and higher fatty acid, alkylphenol polyethylene oxides, esters from a higher fatty acid and polyethylene glycol, esters from a higher fatty acid and polypropylene oxide, and sorbitan esters.

Examples of the polymer dispersants include sodium polycarboxylates and polyvinylalcohol, while examples of the inorganic dispersants, calcium carbonate, but the invention is not limited thereto. Further, it is also possible to add a higher alcohol such as heptanol or octanol or a higher aliphatic hydrocarbon such as hexadecane as a stabilization aid, which is normally, frequently used for prevention of the Ostwald Ripning phenomenon of the monomer emulsion particles in aqueous medium.

During poly-condensation of poly-condensation resin particles in an aqueous medium, it is also possible to add other components normally as needed to toner including colorant, fusing aids such as releasing agent, other charging aids, previously into the aqueous medium and blend them into poly-condensation resin particles during poly-condensation.

(Ester Compound)

The ester compound used in the embodiments of the invention characteristically contains a thioether structure as described above, and the first ester compound is an oligomer or a polymer obtained by poly-condensing a sulfur atom-containing dicarboxylic acid with an aliphatic dialcohol having an even number of carbons, and the second ester compound is an oligomer or a polymer obtained by poly-condensing a sulfur atom-containing dialcohol with a fatty dicarboxylic acid having an even number of carbons. For obtaining higher image strength, both of the first and second ester compounds are preferably sulfur atom-containing monomers having an even number of carbons. Between the first and second ester compounds, the first ester compound is used more preferably from the viewpoints of the cost of monomer (raw material) and the easiness in preparation.

The dicarboxylic acid for the first ester compound is not particularly limited if it is a sulfur atom-containing dicarboxylic acid, and examples thereof include thiodicarboxylic acids such as 3,3'-thiodipropionic acid and thiodibutyric acid; dithiodicarboxylic acids such as 3,3'-dithiodipropionic acid. Among them, thiodicarboxylic acids are more preferably, and 3,3'-thiodipropionic acid is particularly preferable, from the viewpoint of easiness in controlling the melting point to a suitable temperature.

Examples of the dialcohols containing no sulfur atom and having an even number of carbons include ethylene glycol, butanediol, hexanediol, octanediol, decanediol, dodecanediol. Preferable are hexanediol, octanediol, decanediol, dodecanediol, namely, saturated aliphatic dialcohols having an even number of carbons among those having 6 to 12 methylene groups. Each of these dialcohols, which has an even number of alkyl chains, is higher in crystal density and thus can raise the strength of coated film.

The dialcohol for the second ester compound is not particularly limited if it is a sulfur atom-containing dialcohol, and examples thereof include thiodialcohols such as 2,2'-thiodiethanol and 3,3'-thiodipropanol; dithiodialcohols such as 2,2'-dithiodiethanol and 3,3'-dithiodipropanol. Among them, thiodialcohols are more preferably, and 3,3'-thiodipropanol is particularly preferable, from the viewpoint of easiness in controlling the melting point to a suitable temperature.

In addition, examples of the dicarboxylic acids containing no sulfur atom and having an even number of carbons include saturated fatty dicarboxylic acids such as oxalic acid, succinic acid, adipic acid, suberic acid, sebacic acid, decanedicarboxylic acid, and dodecanedicarboxylic acid; unsaturated fatty dicarboxylic acids such as fumaric acid and maleic acid; hydroxydicarboxylic acids such as malic acid. Preferable are adipic acid, suberic acid, sebacic acid, decanedicarboxylic acid, dodecanedicarboxylic acid, namely, saturated fatty dicarboxylic acids having an even number of carbons among those having 6 to 12 methylene groups. Each of these dicarboxylic acids, which has an even number of alkyl chains, is higher in crystal density and thus can raise the strength of coated film.

=Weight-Average Molecular Weight=

Hereinafter, the molecular weight of the first and second ester compounds obtained from the monomer (hereinafter, both compounds may be referred to simply as "ester compounds") will be described. In the present embodiment, the weight-average molecular weight of the ester compounds is preferably 5,000 to 12,000 and more preferably 8,000 to 10,000. Either when the weight-average molecular weight is less than 5,000 or more than 12,000, the plasticity of the ester compound to binder resin may deteriorate easily during heat fusion in the fusing step, solidification by cooling, fusing, for example, on paper, leading to unfavorable recrystallization in an image film after fusion and deterioration in image intensity, in particular against abrasion.

In the present embodiment, the weight-average molecular weight of resin is determined by measuring a THF (tetrahydrofuran)-soluble matter in HLC-8020 manufactured by Toso Corporation and calculating it from the molecular-weight calibration curve prepared by using monodispersion polystyrene standard samples.

Specifically, the column used is TSK gel, SuperHM-H (6.0 mm ID×15 cm×2); the solvent used is THF; the measuring conditions are: sample concentration: 0.5%, flow rate: 0.6 ml/min, sample injection: 10 μl, and measurement temperature: 40° C.; and the calibration curve is prepared by using 10 standard samples: A-500, F-1, F-10, F-80, F-380, A-2500, F-4, F-40, F-128, and F-700. The data-collecting interval in the sample analysis above was 300 ms.

=Melting Point=

The melting point of the crystalline compound (ester compound) is preferably 45° C. to 75° C. When the melting point is within the range, the binder resin is favorable because it has a greater plasticizing action and a favorable low-temperature fusing efficiency.

The melting point of the ester compound can be determined as follows: The apparatus used is a differential scanning calorimeter DSC-7 manufactured by PerkinElmer; the melting points of indium and zinc are used for correction of the temperature of the detector thereof; and the heat of fusion of indium is used for calorimetric correction. A sample is placed on an aluminum plate, while an empty plate is used for reference; the sample is heated from room temperature to 150° C. at a programmed heating rate of 10° C./min, then cooled from 150° C. to −30° C. at a rate of 10° C./min, and then, heated once again from −30° C. to 150° C. at a rate of 10° C./min; and the temperature of the largest endothermic peak observed during second heating is designated as the melting point.

=Content=

Both of the first and second ester compounds in the present embodiment are preferably used at a ratio of 5 to 30% by mass with respect to the binder resin. The compounds when contained in an amount in the range above are favorable in the plasticizing action to binder resin. The content is more preferably 8 to 20% by mass.

=Ethylenic Unsaturated Polymer=

In the present embodiment, the polymer for use as the binder resin or binder resin particles is not particularly limited, and examples thereof include various polymers, but preferable are homopolymers or copolymers of an ethylenic unsaturated monomer including a vinyl monomer. Examples of the monomers for these homopolymers or copolymers include styrenes such as styrene, p-chlorostylene, and α-methylstyrene; (meth)acrylic esters such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; ethylenic unsaturated nitriles such as acrylonitrile and methacrylonitrile; ethylenic unsaturated carboxylic acids such as acrylic acid, methacrylic acid, and crotonic acid; vinylethers such as vinylmethylether and vinylisobutylether; vinylketones such as vinylmethylketone, vinylethylketone, and vinyl isopropenylketone; olefins such as ethylene, propylene, and butadiene; β-carboxyethyl acrylate. Homopolymers from the monomer, copolymers of two or more monomers, and the mixture thereof may be used.

In addition, also included are non-vinyl condensation resins such as epoxy resin, polyester resin, polyurethane resin, polyamide resin, cellulosic resin, and polyether resin; mixtures thereof with an addition polymer resin obtained from the ethylenic unsaturated monomer; graft polymers obtained by polymerizing an ethylenic unsaturated monomer in the presence of these polymers.

Any polymerization initiator suitably selected may be used as the polymerization initiator used for polymerization of the binder resin, and examples thereof include azo or diazo polymerization initiators such as 2,2'-azobis-(2,4-dimethylvaleronitrile), 2,2'-azobisisobutylonitrile, 1,1'-azobis(cyclohexane-1-carbonitrile), and 2,2'-azobis-4-methoxy-2,4-dimethylvaleronitrile; peroxide polymerization initiators such as benzoyl peroxide, methylethylketone peroxide, diisopropyl peroxycarbonate, cumene hydroperoxide, 2,4-dichlorobenzoyl peroxide, and lauroyl peroxide; thiols such as dodecanethiol; ammonium peroxodisulfate.

During polymerization of the ethylenic unsaturated monomer, it is possible to prepare a binder resin particle dispersion by emulsion polymerization, for example, by using an ionic surfactant. Alternatively in the case of the other resin, if the resin is soluble in an oily solvent that is less soluble in water, it is possible to prepare a binder resin particle dispersion by dissolving the resin in such a solvent, dispersing the resin in water together with an ionic surfactant or a poly-electrolyte as fine particles in a dispersing machine such as homogenizer, and then removing the solvent by heating or under reduced pressure.

=Volume-Average Diameter=

The particle diameter of the binder resin particles in the dispersion is preferably 120 to 300 nm and more preferably 160 to 280 nm. The particle diameter within the range is favorable, because the toner obtained has a narrower particle size distribution and contains no free particles, and thus, it is effective to improve the properties and the reliability of the toner.

The particle diameter of the binder resin particles in the dispersion can be determined by using a laser-diffraction particle size distribution analyzer LA-700 (manufactured by Horiba, Ltd.).

=Polyester Resin=

On the other hand, it is more preferable to use a polyester resin as the binder resin for the toner in the present embodiment, from the viewpoint of low-temperature fusing. The polyester resin is also advantageous in that it is easy to adjust the acid value of resin and prepare a binder resin particle dispersion by emulsification and dispersion, for example, by using an ionic surfactant. The polyester resin for use in emulsification and dispersion is prepared from a polyvalent carboxylic acid and a polyvalent alcohol.

Examples of the polyvalent carboxylic acids include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenylsuccinic anhydrides, and adipic acid; alicyclic carboxylic acids such as cyclohexanedicarboxylic acid, and these polyvalent carboxylic acids may be used alone or in combination of two or more. Among these polyvalent carboxylic acids, use of an aromatic carboxylic acid is preferable; and combined use of a trivalent or higher carboxylic acid (trimellitic acid, its acid anhydride, or the like) with a dicarboxylic acid is preferable, for ensuring the resin with a favorable fusing efficiency in a cross-linked or branched structure.

Examples of the polyvalent alcohols include aliphatic diols such as ethylene glycol, diethylene glycol, triethylene glycol, propylene glycol, butanediol, hexanediol, neopentylglycol, and glycerol; alicyclic diols such as cyclohexanediol, cyclohexanedimethanol, and hydrogenated bisphenol A; aromatic diols such as ethylene oxide adducts of bisphenol A and propylene oxide adducts of bisphenol A, and these polyvalent alcohol may be used alone or in combination of two or more. Among these polyvalent alcohols, preferable are aromatic diols, alicyclic diols, and more preferable are aromatic diols. In addition, combined used of a trivalent or higher polyvalent alcohol (glycerol, trimethyrollpropane, or pentaerythritol) is also preferable, for ensuring the resin with a favorable fusing efficiency in a cross-linked or branched structure.

The acid value of polyester resin may be adjusted by esterifying the hydroxyl group and/or the carboxyl group at the polymer terminal, by adding a monocarboxylic acid and/or a monoalcohol additionally to the polyester resin obtained by poly-condensation of a polyvalent carboxylic acid and a polyvalent alcohol. Examples of the monocarboxylic acids include acetic acid, acetic anhydride, benzoic acid, trichloroacetic acid, trifluoroacetic acid, propionic anhydride, and examples of the monoalcohols include methanol, ethanol, propanol, octanol, 2-ethylhexanol, trifluoroethanol, trichloroethanol, hexafluoroisopropanol, phenol.

The polyester resin can be prepared by any one of common methods by poly-condensing the polyvalent alcohol and the polyvalent carboxylic acid. It can be prepared, for example, by mixing the polyvalent alcohol, the polyvalent carboxylic acid, and a catalyst as needed in a reaction container equipped with a thermometer, a stirrer, and a falling film condenser, heating the mixture at 150 to 250° C. under an inert gas (nitrogen gas, etc.), removing byproduct low-molecular weight compounds continuously out of the reaction system, terminating the reaction when the resulting resin reaches a desirable acid value, cooling the resin, and obtaining a desirable reaction product.

Examples of the catalysts used in preparation of the polyester resin include esterification catalyst including organic metals such as dibutyltin dilaurate and dibutyltin oxide; metal alkoxides such as tetrabutyl titanate. The amount of the catalyst added is preferably 0.01 to 1% by mass with respect to the total amount of raw materials.

=Glass Transition Point=

The glass transition point of the binder resin for use in the invention is preferably 52 to 68° C. and more preferably 55 to 64° C. A glass transition temperature in the range is favorable for low-temperature fusing and thus preferable.

In the invention, the glass transition point of the resin can be determined as follows: The apparatus used is a differential scanning calorimeter DSC-7 manufactured by PerkinElmer, and the melting points of indium and zinc are used for temperature correction of the detector in the apparatus and the heat of fusion of indium for calorimetric correction. A method for measuring is based on ASTM D3418-82. A sample is placed on an aluminum plate, while an empty plate is used for reference; the sample is heated from room temperature to 150° C. at a programmed heating rate 10° C./min, then cooled from 150° C. to −30° C. at a rate of 10° C./min, and heated once again from −30° C. to 150° C. at a rate of 110° C./min.

=Weight-Average Molecular Weight=

The weight-average molecular weight of the binder resin for use in the invention is preferably 5,000 to 50,000 and more preferably 8,000 to 35,000.

The weight-average molecular weight of binder resin may be determined in a similar manner to the measurement method for ester compounds described above.

=Content=

The content of the binder resin in toner is preferably 40 to 95% by mass and more preferably 50 to 70% by mass. The rate of the polyester resin in binder resin is preferably 55 to 65% by mass, for obtaining a more favorable low-temperature fusing efficiency.

Method of Producing Electrostatic Image Developing Toner

The method of producing the toner according to the invention is not particularly limited, if the crystalline polysulfide ester resin obtained by the liquid phase poly-condensation described above is used. For example, a toner may be prepared from a crystalline polysulfide ester resin in a blending and pulverizing process. However, a toner is preferably prepared by an emulsion-polymerization flocculation process.

In such a case, the toner can be prepared in an aggregation step of obtaining aggregated particles by aggregating raw particles in a raw dispersion wherein raw resin particles including particles of crystalline polysulfide ester resin are dispersed and a subsequent coalescence step of fusing the aggregate particles by heating; and it is particularly preferable to use the above-described resin particle dispersion wherein crystalline polysulfide ester resin particles are dispersed in preparing the raw dispersion.

In the aggregation step, it is possible to form aggregate particles by preparing a raw dispersion by mixing the resin particles wherein crystalline polysulfide ester resin particles are dispersed and other resin particle dispersion, colorant particle dispersion, releasing agent particle dispersion, and the like as needed, adding a coagulant thereto additionally, and thus aggregating the various raw particles heterogeneously.

It is also possible to form a shell layer on the surface of core particles by using the aggregate particles thus obtained as core particles and adding the resin particles dispersion wherein crystalline polysulfide ester resin particles are dispersed or another resin particle dispersion additionally.

Although a colorant particle dispersion separately prepared is used in preparing the raw dispersion above, the colorant particle dispersion is not needed if a colorant is blended previously to the resin particles.

A surfactant, an inorganic salt, or a salt of bivalent or higher-valent metal can be used favorably as the coagulant. In particular, use of a metal salt is preferable, from the point of control of aggregating tendency control and properties such as toner charging properties.

Additionally, a surfactant may be used for emulsion polymerization of binder resin, dispersion of pigment, dispersion of resin particles, dispersion of releasing agent, coagulation, stabilization of coagulation particles, and the like. Specifically, combined use of an anionic surfactant such as sulfuric acid ester salts, sulfonic acid salts, phosphoric acid esters, and soaps; a cationic surfactant such as amine salts and quaternary ammonium salts, and a nonionic surfactant such as a polyethylene glycol, alkyl phenol ethylene oxide adduct, polyvalent alcohol surfactant is also effective. Any one of commonly used dispersers, including rotary shearing homogenizer and medium-containing dispersers such as ball mill, sand mill, and Dynomill, may be used for dispersion.

In the resin particle dispersion, it is possible to use a resin particle dispersion prepared by addition-polymerization, for example, by emulsion polymerization commonly known in the art, in addition to the dispersion prepared by poly-condensation described above.

Examples of the addition-polymerization monomers for preparation of these resin particle dispersions include styrenes such as styrene and parachlorostyrene; vinyl monomers such as vinylnaphthalene, vinyl chloride, vinyl bromide, and vinyl fluoride, vinylesters such as vinyl acetate, vinyl propionate, vinyl benzoate, and vinyl butyrate; methylene aliphatic carboxylic esters such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate; acrylonitrile, methacrylonitrile, acrylamide, vinylethers such as vinyl methyl ether, vinyl ethyl ether and vinyl isobutyl ether; monomers having a N-containing polar group including N-vinylcompounds such as N-vinylpyrrole, N-vinylcarbazole, N-vinylindole and N-vinylpyrrolidone; vinyl carboxylic acids such as methacrylic acid, acrylic acid, cinnamic acid, and carboxyethyl acrylate; and it is possible to use a homopolymer or copolymer of the vinyl monomers above or a mixture thereof with one of various waxes.

If an addition-polymerization monomer is used, the resin particle dispersion can be prepared by emulsion polymerization in the presence of an ionic surfactant; and if the other resin is used, the resin particle dispersion can be prepared by dissolving the resin in an oily solvent that is less soluble in water if soluble, dispersing the solution and forming particles in an aqueous medium with an ionic surfactant or a polyelectrolyte in a dispersing machine such as homogenizer, and then removing the solvent by heating or under reduced pressure.

Then in the coalescence step (fusion step) after aggregation step, the toner is prepared by fusing the aggregate particles while heating them at a temperature of the melting point of resin particles or higher (a temperature of glass transition point or higher in the case of an amorphous resin) and washing and drying the particles as needed.

After the coalescence step, desired toner particles are processed as needed in washing, solid-liquid separation, and drying steps, and the particles are preferably washed thoroughly with ion-exchange water in the washing step, considering the charging properties of the toner. The solid-liquid separation step is not particularly limited, but preferable from the point of productivity is, for example, suction filtration or pressure filtration. The drying step is also not particularly limited, but preferable from the point of productivity is freeze drying, flash jet drying, flow drying, vibrational flow drying, or the like.

Other Materials for Toner and Properties of Toner

Hereinafter, materials for toner other than the binder resin and the properties of the toner will be described. The materials described below may be used, independent of the production method.

(Colorant)

First, examples of colorants include the followings:

Black pigment such as carbon black, copper oxide, manganese dioxide, aniline black, activated carbon, non-magnetic ferrite and magnetite;

Yellow pigments such as zinc yellow, iron oxide yellow, cadmium yellow, chromium yellow, Hanza Yellow, Hanza Yellow 10G, Benzidine yellow G, Benzidine Yellow GR, threne yellow, quinoline yellow, and Permanent Yellow NCG;

Orange pigments such as red chrome yellow, molybdenum orange, Permanent Orange GTR, pyrazolone orange, Vulcan Orange, Benzidine orange G, Indanthrene Brilliant Orange RK, and Indanthrene Brilliant Orange GK;

Red pigments such as bengala, cadmium red, red lead, mercury sulfide, Watchung Red, Permanent Red 4R, Lithol Red, Brilliant Carmine 3B, Brilliant Carmine 6B, DuPont Oil Red, pyrazolone red, Rhodamine B Lake, Lake Red C, rose bengal, eoxine red, and alizarin lake;

Blue pigments such as iron blue, cobalt blue, alkali blue lake, Victoria blue lake, Fast Sky Blue, Indanthrene blue BG, aniline blue, ultramarine blue, Calco Oil Blue, methylene blue chloride, phthalocyanine blue, phthalocyanine green, and malachite green oxalate;

Purple pigments such as manganese purple, Fast Violet B, and methyl violet lake;

Green pigments such as chromium oxide, chromium green, pigment green, malachite green lake, and Final Yellow Green G;

White pigments such as zinc white, titanium oxide, antimony white, and zinc sulfide; and Extender pigments such as barytes, barium carbonate, clay, silica, white carbon, talc, and alumina white.

Alternatively, examples of dyes include various dyes such as basic, acidic, dispersion, and direct dyes, and specific examples thereof include nigrosine, methylene blue, rose bengal, quinoline yellow, ultramarine blue.

These colorants may be used alone or in combination. It is possible to prepare a colorant particle dispersion with these colorants, for example, by using a rotary shearing homogenizer, a medium-dispersing machine such as ball mill, sand mill or attriter, a high-pressure countercollision dispersing machine. These colorants may also be dispersed in an aqueous system in a homogenizer by using a polar surfactant.

The colorants are selected from the viewpoints of hue angle, chroma, lightness, weather resistance, OHP transmitting property, and dispersion in toner.

The colorant is added in an amount in the range of 4 to 15 wt % with respect to the total weight of the solid matters in toner. Different from other coloring agents, magnetic particles may be added in an amount of 12 to 240 wt %, if added as the black coloring agent.

The amount of the coloring agents blended is favorably the minimum amount required for ensuring coloring in the fusing step. It is possible to ensure the OHP transparency and color development of the formed image by adjusting the average diameter (median diameter) of the colorant particles in the range of 100 to 330 nm.

The average diameter of colorant particles is determined, for example, by using a laser-diffraction grain size distribution analyzer (LA-920, manufactured by Horiba, Ltd.).

These colorants may be used alone or in combination, or alternatively, in the state of solid solution. These colorants may be dispersed by any one of known methods, for example, in a rotary shearing homogenizer, ball mill, or sand mill. A medium-dispersing machine such as attriter, a high-pressure countercollision-dispersing machine is used favorably.

In addition, these colorant particles are preferably dispersed in an aqueous dispersion medium by using a polar surfactant, for example, in the above-described homogenizer.

(Magnetic Powder)

A magnetic powder may be added to the toner according to the invention, if it is used as a magnetic toner. Specifically, substances magnetized in magnetic field such as ferromagnetic powders of iron, cobalt and nickel and compounds such as ferrite and magnetite are used. In producing a toner in an aqueous phase, caution should be given to migration of the magnetic material into the aqueous phase; and it is preferable to modify the surface of the magnetic material previously, for example, by hydrophobilization treatment.

In addition, any one of ferrite, magnetite, metals such as reduced iron, cobalt, nickel, and manganese, the alloys thereof, or compounds containing the metal may be added as an internal additive; and any one of charge control agents commonly used including quaternary ammonium salts, nigrosin compounds, dyes prepared from aluminum, iron, and chromium complexes, and triphenylmethane pigments may be used as an charge control agent; but materials less soluble in water are favorable for the purpose of controlling the ionic strength, which may affects the efficiency of the coagulation and fusion in the fusing step, and reducing wastewater pollution.

(Releasing Agent)

Typical examples of the releasing agent include various ester waxes; low-molecular weight polyolefins such as polyethylene, polypropylene, and polybutene; silicones that soften easily by heating; fatty acid amides such as oleic amide, erucic amide, ricinoleic amide, and stearic amide; vegetable waxes such as carnauba wax, rice wax, candelilla wax, Japan tallow, and jojoba oil; animal waxes such as beeswax; mineral-petroleum waxes such as montan wax, ozokerite, ceresin, paraffin wax, microcrystalline wax, and Fischer-Tropsch wax; the modified materials thereof.

Preferable are paraffin waxes, microcrystalline waxes, and polyolefin waxes; and particularly preferable are paraffin waxes and polyethylene waxes. Less polarizable releasing agents such as paraffin wax and polyethylene wax are preferable, as they are less compatible with the toner binder resin and the crystalline compound, and thus, allow easier release of the releasing agent during fusing.

The melting point of the releasing agent for use in the toner according to the invention is preferably 60 to 120° C. and more preferably 85 to 105° C.

The volume-average particle size of the releasing agent particles in dispersion is preferably 120 to 360 nm and more preferably 160 to 300 nm. The volume-average diameter in the range is preferable, because it is possible to control the fluctuation in composition among toner particle and improve the properties and reliability of the toner.

These waxes are hardly or scarcely soluble in solvents such as toluene at around room temperature.

These waxes are dispersed in an aqueous medium together with a polymer electrolyte, such as an ionic surfactant, polymeric acid, polymeric base, and may be further dispersed into the form of fine particles, by dispersing the solution at a temperature higher than the melting point of the waxes under high shearing force in a homogenizer or high-pressure extrusion dispersing machine (Gaulin homogenizer, manufactured by APV Gaulin) making a dispersion particles with volume-average diameter of 1μ or smaller.

The releasing agent is preferably added in an amount in the range of 5 to 25 wt % with respect to the total weight of the solid matters in toner, for improvement in the release property of the fixed image in the oil-less fusion system. The particle diameter of the particles in the releasing agent particle dispersion can be determined, for example, by using a laser-diffraction particle size distribution analyzer (manufactured by Horiba, Ltd., LA-920).

If a releasing agent is used in preparation of a toner by emulsion polymerization, it is preferable to first form aggregate particles by blending and aggregating resin particles, colorant particles and releasing agent particles and then deposit resin particles on the surface of the aggregate particles thus formed by adding the resin particle dispersion additionally, for improvement in toner charging properties and durability.

(Inorganic and Organic Fine Particles)

It is possible to add inorganic fine particles in the wet state, for stabilization of toner electrostatic properties in the invention. Examples of the inorganic powders include powders of all surface additives commonly used as an external toner in the art such as silica, alumina, titania, calcium carbonate, magnesium carbonate, and tricalcium phosphate; and the inorganic powder may be used as dispersed in an ionic surfactant, a polymeric acid, or a polymeric base.

For improvement in fluidity and cleaning efficiency, it is also possible to add inorganic fine particles of silica, alumina, titania, calcium carbonate or organic fine particles of vinyl resin, polyester, silicone, in the drying state under shearing force on the surface of toner after drying and use the particles as a flow-improving aid or a cleaning aid, in a similar manner to common toner production.

It is also favorable to prepare a toner by the method in the following embodiment. In the initial stage of mixing an ester compound dispersion, a binder resin fine particle dispersion, and a colorant particle dispersion, the balance in the amounts of various polar ionic dispersants is intentionally deviated; the dispersion is neutralized ionically by adding an inorganic metal salt polymer such as polyaluminum chloride; and then base aggregate particles in the first stage are prepared and stabilized by heating the dispersion at a temperature not lower than the glass transition point of the binder resin. In the second stage, a resin fine particle dispersion, which was previously treated with an ionic dispersant having a polarity and in an amount correcting the deviation in ionic balance, are added; the dispersion is then heated, as needed, shortly at a temperature not higher than the glass transition points of the resins contained in the aggregated binder resin fine particles and the resin particles added, and stabilized additionally by heating at a temperature higher than the glass transition point; and the particles added in the second stage of aggregate formation may be deposited and thermally fused on the surface of the base aggregate particles by heating the particles at a temperature not lower than the glass transition points. The stepwise operations for aggregation may be repeated multiple times. The two-stage method is effective for improving the confinement of the ester compound, releasing agent and colorant in the particle.

More specifically, the two-stage method includes additionally a step of forming adhered particles by adding and mixing a fine particle dispersion wherein the fine particles are dispersed in the aggregate particle dispersion and depositing the fine particles on the aggregate particles (deposition step), between the aggregation step and the thermal coalescence step.

In the deposition step, adhered particles are formed by deposition of fine particles on aggregate particles by adding and mixing a fine particle dispersion in the aggregate particle dispersion prepared in the aggregation step, and the added fine particles, which are the particles newly added to the aggregate particles, are referred to hereinafter as "added fine particles" in the present specification. The added fine particles may contain, in addition to the binder resin fine particles, one or more of ester compound particles, releasing agent particles, colorant particles. The method of adding the fine particle dispersion is not particularly limited, and may be performed in any way, for example, gradually and continuously or stepwise multiple times as the dispersion is divided. By adding the fine particles (added fine particles) in this way, it becomes possible to suppress generation of micro-particles, make the particle size distribution of the toner for developing electrostatic image obtained sharper, and improve image quality.

It is also possible by installing a deposition step to form an apparent shell structure, reduce exposure of internal additives such as colorant and lower-melting point compounds on the toner surface, and consequently improve the charging properties and the lifetime of toner. Further, presence of the deposition step is also advantageous in that it allows preservation of the distribution and suppression of the variation in the particle size during fusion in the thermal coalescence step, eliminates the need for addition of a stabilizer such as surfactant, base or acid for improvement in stability during fusion or reduce the addition amount thereof to the minimum, and facilitates cost reduction and quality improvement. In addition, use of the method enables easier control of toner shape in the thermal coalescence step by adjustment of temperature, agitation frequency, pH, and the like.

It is possible to control the degree of aggregation and/or deposition by properly selecting the kind and the amount of the ionic surfactant for adjustment of the polarity of dispersion in the aggregation step for preparing aggregate particles and/or the deposition step for depositing the added fine particles. For example, it is possible to aggregate binder resin fine particles, colorant particle, by mixing binder resin fine particles and ester compound particles in an anionic surfactant-containing solution and a colorant in a cationic surfactant-containing solution respectively and mixing these solutions.

It is also possible to aggregate and/or deposit particles by previously deviating the balance of the polarity and the blending amount of the ionic surfactant contained in the dispersion mixed and adding an ionic surfactant having a polarity and in an amount correcting the imbalance.

In the aggregation step, it is possible, for example, to use a method of forming aggregate particles by mixing binder resin fine particle, colorant particle, ester compound, and low-melting point compound particle dispersions different in polarity, and as needed a releasing agent particle dispersion, or a method of forming aggregate particles by adding a polar surfactant different in polarity to a mixed dispersion of binder resin fine particles, colorant, ester compound, and lower point compound dispersions and as needed a releasing agent particle dispersion.

In the thermal coalescence step, the dispersion is preferably heated at a temperature in the range of T+10 to T+30° C., when the glass transition point of binder resin is designated as T ° C.

In the invention, desired toner particles are processed as needed in washing, solid-liquid separation, and drying steps after thermal fusion, and the particles are preferably washed thoroughly with ion-exchange water in the washing step, for generation and preservation of the favorable charging properties of toner. The solid-liquid separation step is not particularly limited, but preferable from the point of productivity is, for example, filtration under applied or reduced pressure. The drying step is also not particularly limited, and preferable from the point of productivity is freeze drying, flash jet drying, flow drying, vibrational flow drying, or the like.

The dispersion medium for use in the dispersion step is an aqueous dispersion medium, and contains, for example, water such as distilled water or ion-exchange water as the principal component and a water-miscible solvent such as alcohol in a small amount (30 vol % or less). The water-miscible dispersion media may be contained alone or in combination of two or more.

An inorganic metal salt having a bivalent charge or higher may be used as the metal ion (coagulant) for use in the aggregation step. The metal elements for the inorganic metal salt are elements having a bivalent charge or higher belonging to groups 2A, 3A, 4A, 5A, 6A, 7A, 8, 1B, 2B, and 3B in the periodic table (long periodic table), (corresponding to groups 2 to 8 and 11 to 13 in the Nomenclature of Inorganic Chemistry revised by IUPAC in 1989).

Typical examples thereof include metal salts such as calcium chloride, calcium nitrate, barium chloride, magnesium chloride, zinc chloride, aluminum chloride, and aluminum sulfate; inorganic metal polymers such as polyaluminum chloride, polyaluminum hydroxide, and calcium polysulfide. Among them, aluminum salts and their polymers are favorable. Generally, for obtaining sharper particle size distribution, the valency of the inorganic metal salt is more favorably trivalent or higher than bivalent, and thus, inorganic metal salt polymers are more favorable if the valency is the same.

The amount of the coagulant added is not particularly limited, if it is in the range that does not impair the advantageous effects of the invention, but specifically, it is in the range of 0.01 to 10% by mass, preferably 0.05 to 5% by mass, and more preferably 0.1 to 2% by mass, in the dispersion. An addition amount of less than 0.01% by mass may make the dispersion such as binder resin particle dispersion, colorant particle dispersion, or ester compound particle dispersion unstable, consequently causing aggregation or generation of free particular particles during aggregation because of the difference in stability between particles. Alternatively, an amount of more than 10% by mass may expand the particle size distribution of the aggregate particles and make it difficult to control the particle diameter thereof.

In the method of producing a toner according to the invention, examples of the surfactants for use in emulsion polymerization of binder resin fine particles, dispersion of colorant, addition and dispersion of binder resin fine particles, and dispersion, aggregation, or stabilization of ester compound or releasing agent include anionic surfactants such as sulfate ester salts, sulfonate salts, phosphate esters, and soaps; cationic surfactants such as amine salts and quaternary ammonium salts. In addition, combined use of a nonionic surfactant such as polyethylene glycol, alkylphenol ethylene oxide adducts, or polyvalent alcohol is also effective. Common mixers including rotary shearing homogenizer and medium-containing mills such as ball mill, sand mill, and Dynomill can be used as the means for dispersion.

The acid value of the toner according to the invention is preferably in the range of 5 to 50 mg-KOH, which is important for improving confinement of the ester compound particles, colorant particles, and the like in toner, stabilizing the toner, as well as improving the charging properties thereof A toner having an acid value in the range above is superior in the confinement of the ester compound particles, colorant particles, and the like and the stability of toner, and can be properly charged electrostatically. The toner is also superior in fusing efficiency, because the acid value-providing component is contained in a suitable amount and thus the toner is not cross-linked.

The cumulative volume-average diameter $D_{50v}$ of the toner according to the invention is in the range of 3.0 to 9.0 μm and preferably in the range of 3.0 to 5.0 μm. A cumulative volume-average diameter $D_{50v}$ of less than 3.0 μm may lead to increase in adhesion force and decrease in printing efficiency. Alternatively, a diameter of more than 9.0 μm may lead to deterioration in image resolution.

Alternatively, the volume-average particle distribution index GSDv of the toner obtained is preferably 1.30 or less. A GSDv of more than 1.30 may lead to decrease in resolution and cause scattering of the toner and image defects such as high background soil.

In the invention, the electrolyte solution used is Isotone II (manufactured by Beckmann Coulter); and in measurement, 0.5 to 50 mg of test sample (toner) is added to 2 ml of an aqueous 5% surfactant (sodium alkylbenzenesulfonate) solution used as the dispersant. The mixture is added to 100 to 150 ml of the electrolyte solution. The test sample-suspended electrolyte is dispersed in a ultrasonic homogenizer for about 1 minute; the volume- and number-average distributions of the particles are determined by measuring the particle size distribution of the particles of 2.0 to 64.0 μm in diameter, by using a Coulter Counter® TA-II and an aperture having a diameter of 100 μm. The number of particles measured is 50,000. The weight-average particle diameter is obtained from the volume- and number-average distributions.

The cumulative volume-average diameter $D_{50v}$ and the average particle size distribution index are determined as follows: cumulative distribution curves are drawn from the smaller side, by using the volume and the number of toner particles classified according to particle ranges (channel) partitioned based on the particle size distribution, as determined for example by an analyzer such as Coulter Counter® TAII (manufactured by Beckmann Coulter), and the accumulated volume-average and accumulated number-average particle diameters at a cumulative count of 16% is designated as $D_{16v}$ and $D_{16p}$, those at a cumulative count of 50%, $D_{50v}$ and $D_{50p}$, and those at cumulative count of 84%, $D_{84v}$ and $D_{84p}$.

From the results, the volume-average particle diameter distribution index (GSDv) is calculated according to Formula $(D_{84v}/D_{16v})^{1/2}$, and the number-averaged particle diameter distribution index (GSDp), Formula $(D_{84p}/D_{16p})^{1/2}$.

The toner shape factor SF1 obtained is in the range of 100 to 140, preferably 110 to 135, from the point of image-forming property. The shape factor SF1 is determined as follows: The toner shape factor SF1 is determined by incorporating optical microscopic images of toner particles spread on the surface of a slide glass into a Luzex image-analyzing instrument via a video camcorder, measuring the maximum length (ML) and the projection area (A) of 50 pieces of toner particles or more, and calculating according to the following Equation (1).

$$SF1=[(\text{Maximum Length})^2/\text{Projection Area}]\times(100\times\pi)/4 \quad \text{Equation (1)}$$

The amount of the electrostatic charge on the toner for developing electrostatic image according to the invention is preferably in the range of 20 to 80 μC/g, preferably 25 to 35 μC/g, as absolute value.

An amount of the electrostatic charge in the range is favorable, because it is possible to avoid staining on background (background soil) and obtains a favorable image density. The ratio of the amount of the electrostatic charge on the toner for developing electrostatic image in summer (high temperature and high humidity) to that in winter (low temperature and low humidity) is preferably in the range of 0.5 to 1.5 and more preferably 0.7 to 1.3. A ratio in the range is favorable, because the charging properties of the toner are less dependent on the environment and the amount of electrostatic charge is stabilized.

The toner according to the invention preferably has a glass transition point (Tg) of 50 to 65° C. and more preferably 52 to 60° C. When the Tg is in the range of 50 to 65° C., the toner is superior in storage stability and image durability such as document-offsetting resistance and can be used favorably.

External additives may be added to the toner obtained after drying, for improvement in fluidity and cleaning efficiency. Favorable examples of the external additives include inorganic particles of silica, alumina, titania, calcium carbonate, and resin particles of vinyl resin, polyester, silicone.

When an external additive is added as it is dry, the external additive may be added while a shearing force is applied to the toner particles.

Alternatively, when an external additive is added as it is wet in an aqueous medium, if the external additive is known inorganic particles of silica, alumina, titania, calcium carbonate, magnesium carbonate, tricalcium phosphate, or the like, the inorganic particles may be added externally after the particles are dispersed with an ionic surfactant, polymeric acid, or polymeric base.

Developer

The toner according to the invention is used as an electrostatic image developer (hereinafter, may be referred to as "developer"). The developer contains at least the toner according to the invention, and may have any composition according to applications.

Specifically, only the toner according to the invention is used for a one-component image developer, while the toner according to the invention and a carrier are used for a two-component developer. The carrier is not particularly limited, and any known carrier may be used.

The carrier is preferably a carrier having ferrite, iron powder, or the like as its core and enclosed with a resin. The core material (carrier core material) used is not particularly limited, but preferable are magnetic metals such as iron, steel, nickel and cobalt, and magnetic oxides such as ferrite and magnetite, glass bead and the like; and a magnetic carrier is preferable, for example, for use in the magnetic brush process. The average diameter of the carrier core material is preferably 3 to 10 times larger than the toner volume-average diameter.

Examples of the coating resins include acrylic resins, styrene resins, amino resins containing urea, urethane, melamine, guanamine, and aniline, amide resins, urethane resins, or the copolymer resins thereof. Two or more resins selected from the resins above may be used in combination as the carrier-coating resin. In addition, binder resin, inorganic, or other fine particles may be used as dispersed in the coating resin, for control of the electrostatic charge.

Examples of the methods of forming the resin-coat layer on the surface of the carrier core material include an immersion method of immersing the powder of carrier core material in a film-forming solution, a spraying method of spraying a film-forming solution on the surface of a carrier core material, a fluidized-bed method of spraying a film-forming solution on a carrier core material in the state floating by fluidizing air, a kneader-coater method of mixing a carrier core material and a film-forming solution in a kneader coater and removing the solvent, a powder-coating method of coating a film resin by pulverizing it into fine particles and mixing the particles with a carrier core material at a temperature not lower than the melting point of the film resin in a kneader coater and then cooling; and among them, particularly preferably used are the kneader-coater and the powder-coating methods.

The amount of the coated resin formed by the method is 0.5 to 10% by mass with respect to the carrier core material. The blending ratio (by mass) of the toner to the carrier is preferably in the range of 1:100 to 30:100, more preferably 3:100 to 20:100, as toner:carrier.

Image-Forming Process

The developer according to the invention (toner) can be used in image-forming processes in the common electrostatic image-developing processes (electrophotographic processes).

Image formation by using the developer according to the invention is not particularly limited if it is a known electrophotographic process of forming an image by using the developer according to the invention, and may be performed in any one of known image-forming machines including copying machines, facsimiles, and the like.

Specifically, the process preferably includes an image-forming step of forming an electrostatic latent image on the latent image-holding member surface, a developing process of forming a toner image by developing the electrostatic latent image formed on the latent image-holding member surface with the developer according to the invention, a transferring process of transferring the toner image formed on the latent image-holding member surface onto the surface of a recording medium such as paper, and a fusing step of thermally fusing the toner image transferred on the recording medium surface. It may also contain other known steps such as a cleaning step of cleaning the toner remaining on the latent image-holding member surface after the transferring process.

These steps are common steps that are described, for example, in JP-A Nos. 56-40868 and 49-91231.

An embodiment including an additional recycle step is preferable for the image-forming process according to the invention. The recycle step is a step of recycling the toner recovered in the cleaning step as the developer for use in the developing process.

The image-forming process in the embodiment including a recycle step may be used in toner-recycling-type image-forming machines such as copying machine and facsimile. It is also possible to apply the process to a recycling system in an embodiment of recycling toner simultaneously with developing without use of a cleaning step.

EXAMPLES

Hereinafter, the invention will be described in more detail with reference to Examples, but it should be understood that the invention is not limited to the following Examples.

The toners used in the following Examples are those mainly prepared in the emulsion-polymerization flocculation process, and in such cases, the toners are prepared according to the following procedure:

The resin particle dispersion, the colorant particle dispersion, and the releasing agent particle dispersion shown below are prepared first; a metal salt polymer is added to a raw dispersion prepared by mixing the dispersions at a particular ratio while the dispersion is stirred; and the dispersion is ionically neutralized, to give aggregate particles. Then, an inorganic hydroxide is added to the raw dispersion containing the aggregate particles formed for adjustment of the pH of the reaction system from a weakly acidic to neutral, and the resin particles are fused by heating the dispersion to a temperature not lower than the glass transition temperature of the resin particles. After reaction, the particles are washed thoroughly, solid-liquid separated, and dried, to give a desired toner.

The molecular weight thereof is determined under the following conditions: GPC is determined by using "HLC-8120GPC, SC-8020 (manufactured by Toso Corporation)", two columns of "TSKgel, SuperHM-H (manufactured by Toso Corporation, 6.0 mm ID×15 cm)", and an eluent of THF (tetrahydrofuran). In a typical experiment, the sample concentration is 0.5%; flow rate, 0.6 ml/min, sample injection, 10 μl, and measuring temperature, 40° C. An IR detector is used for measurement. The calibration curve is prepared by using 10 polystyrene standard samples: "TSK Standards" manufactured by Tosoh Corp.: "A-500", "F-1", "F-10", "F-80", "F-380", "A-2500", "F-4", "F-40" "F-128", and "F-700".

(Preparation of Crystalline Polysulfide Ester Resin Particle Dispersion (1))

| | |
|---|---|
| Dodecylbenzenesulfonic acid: | 4.0 parts by weight |
| 1,9-Nonanediol: | 90.0 parts by weight |
| 3,3'-Thiodipropionic acid: | 100.0 parts by weight |

The components above are mixed in a 500-ml flask, heated to 120° C. with a mantle heater for fusion of the mixture, and kept at 80° C. for 8 hours while agitated with Three One Motor and de-aerated, to give a viscous fused material.

An aqueous solution for neutralization prepared by dissolving 1.5 parts by weight of 1N NaOH in 810 parts by weight of ion-exchange water and heated to 90° C. is added to the flask containing the fused material, and the mixture is emulsified with a homogenizer (Ultra-Turrax® T50, manufactured by IKA) for 5 minutes and then the flask is cooled with water at room temperature, to give a crystalline polysulfide ester resin particle dispersion (1) having an average particle diameter of 280 nm, a melting point of 72° C., a weight-average molecular weight of 12,000, and a solid content of 20 wt %.

(Preparation of Crystalline Polysulfide Ester Resin Particle Dispersion (2))

| | |
|---|---|
| Dibutyltin oxide: | 0.2 parts by weight |
| 1,6-Hexanediol: | 66.4 parts by weight |
| 3,3'-Thiodipropionic acid: | 100.0 parts by weight |

The components above are mixed in a 500-ml flask, heated to 130° C. with a mantle heater for fusion of the mixture, and kept at 180° C. for 10 hours while agitated with Three One Motor and de-aerated, to give a viscous fused material.

An aqueous solution for neutralization prepared by adding 1.5 parts by weight of Sodium dodecylbenzensulfonate in 810 parts by weight of ion-exchange water is added to the fused material and the mixture was emulsified in CLEARMIX having a pressure chamber (manufactured by M technique Co., Ltd.) at 120° C. for 5 minutes, and the flask was cooled with water at room temperature, to give a crystalline polysulfide ester resin particle dispersion (2), having an average particle diameter of 330 nm, a melting point of 53° C., a weight-average molecular weight of 12,000, and a solid content of 20 wt %.

(Preparation of crystalline Polysulfide Ester Resin Particle Dispersion (3))

| | |
|---|---|
| Dodecylsulfuric acid: | 2.0 parts by weight |
| Dithiodipropionic acid: | 55.0 parts by weight |
| Dodecanedicarboxylic acid: | 63.0 parts by weight |

The components above are mixed in a 500-mil flask, heated to 120° C. with a mantle heater for fusing of the mixture; 780 parts by weight of ion-exchange water heated to 90° C. is added thereto; the mixture is emulsified in a homogenizer (Ultra-Turrax®, manufactured by IKA) for 10 minutes and heated at 80° C. for 8 hours while agitated, and then cooled with water at room temperature, to give a crystalline polysulfide ester resin particle dispersion (3) having an median particle diameter of 450 nm, a melting point of 51° C., a weight-average molecular weight of 3,800, and a solid content of 20 wt %.

(Preparation of Crystalline Polysulfide Ester Resin Particle Dispersion (4))

| | |
|---|---|
| Dodecylbenzenesulfonic acid: | 2.0 parts by weight |
| Thiodipropanol: | 39.3 parts by weight |
| Dodecanedicarboxylic acid: | 120.0 parts by weight |
| 1,9-Nonanediol: | 42 parts by weight |

The components above are mixed in a 500-ml flask, heated to 140° C. with a mantle heater for fusing of the mixture, and kept at 90° C. for 10 hours while agitated with Three One Motor and de-aerated, to give a viscous fused material.

An aqueous solution for neutralization prepared by dissolving 1.0 parts by weight of 1N NaOH in 800 parts by weight of ion-exchange water is also added to the fused material, and the mixture is emulsified with a homogenizer (Ultra-Turrax®, manufactured by IKA) for 10 minutes and then the flask is cooled with water at room temperature, to give a crystalline polysulfide ester resin particle dispersion (4) having an median particle diameter of 210 nm, a melting point of 66° C., a weight-average molecular weight of 14,200, and a solid content of 20 wt %.

(Preparation of Crystalline Polysulfide Ester Resin Particle Dispersion (5))

| | |
|---|---|
| Dodecylbenzenesulfonic acid: | 2.0 parts by weight |
| 3,3'-Thiodipropanol: | 46.0 parts by weight |
| 1,9-Nonanediol: | 44.0 parts by weight |
| Dodecanedicarboxylic acid: | 125.0 parts by weight |

The components above are mixed in a 500-ml flask, heated to 140° C. with a mantle heater for fusion of the mixture, and kept at 90° C. for 10 hours while agitated with Three One Motor and de-aerated, to give a viscous fused material.

An aqueous solution for neutralization prepared by dissolving 1.5 parts by weight of 1N NaOH in 785 parts by weight of ion-exchange water and heated to 90° C. is also added to the fused material, and the mixture is emulsified with a homogenizer (Ultra-Turrax®, manufactured by IKA) for 10 minutes and then the flask is cooled with water at room temperature, to give a crystalline polysulfide ester resin particle dispersion (5) having an median particle diameter of 160 mm, a melting point of 62° C., a weight-average molecular weight of 12,200, and a solid content of 20 wt %.

(Preparation of Crystalline Polysulfide Ester Resin Particle Dispersion (6))

| | |
|---|---|
| Dodecylbenzenesulfonic acid: | 2.0 parts by weight |
| 1,6-Hexanediol: | 76.0 parts by weight |
| Sebacic acid: | 65.0 parts by weight |
| Thiodipropionic acid: | 57.0 parts by weight |

The components above are mixed in a 500-ml flask, heated to 140° C. with a mantle heater for fusion of the mixture, and kept at 90° C. for 10 hours while agitated with Three One Motor and de-aerated, to give a viscous fused material.

An aqueous solution for neutralization prepared by dissolving 1.5 parts by weight of 1N NaOH in 785 parts by weight of ion-exchange water and heated to 90° C. is added to the fused material similarly, and the mixture is emulsified with a homogenizer (Ultra-Turrax®, manufactured by IKA) for 10 minutes, and then the flask is cooled with water at room temperature, to give a crystalline polysulfide ester resin particle dispersion (6) having an median particle diameter of 160 nm, a melting point of 62° C., a weight-average molecular weight of 12,200, and a solid content of 20 wt %.

(Preparation of Non-Crystalline Polyester Resin Particle Dispersion (7))

| | |
|---|---|
| Propylene oxide adduct of bisphenol A (propylene oxide addition amount: 2.2 mole): | 77.4 parts by weight |
| Ethylene oxide adduct of bisphenol A (ethylene oxide addition amount: 2.2 mole): | 33.2 parts by weight |
| Terephthalic acid: | 60.2 parts by weight |
| Trimellitic anhydride: | 17.2 parts by weight |
| Dodecenylsuccinic anhydride: | 12.2 parts by weight |
| Di-n-butyltin oxide: | 0.4 parts by weight |

The materials are placed in a stainless steel flask equipped with a thermometer, a stainless steel steering blade, a falling film condenser and a nitrogen-supplying tube, heated with a mantle heater to 230° C., and allowed to react while stirred under reduced pressure and nitrogen stream for 8 hours, to give a noncrystalline polyester resin having a glass transition temperature of 64° C. and a weight-average molecular weight of 15,000.

Then, 200 parts by weight of the resin is dissolved in 200 parts by weight of ethyl acetate; the mixture is added to and emulsified in 800 parts by weight of ion-exchange water containing 0.5 wt % sodium dodecylsulfate while stirred with an Ultra-Turrax®; and the solvent is removed by heating at 60° C., to give a non-crystalline polyester resin dispersion (7) having a median diameter of 140 nm and a solid content of 20 wt %.

(Preparation of Non-Crystalline Vinyl Resin Particle Dispersion (8))

| | |
|---|---|
| Styrene: | 460 parts by weight |
| n-Butyl acrylate: | 140 parts by weight |
| Acrylic acid: | 12 parts by weight |
| Dodecanethiol: | 9 parts by weight |

A solution is first prepared by mixing and dissolving the component above. Separately, 12 parts by weight of an anionic surfactant (DOW-FAX, manufactured by Dow Chemical Company) is dissolved in 250 parts by weight of ion-exchange water, and the solution above is added thereto; and the resulting mixture is dispersed and emulsified in a flask, to give an emulsion (monomer emulsion A).

Separately, 1 part by weight of an anionic surfactant (DOW-FAX, manufactured by Dow Chemical Company) is dissolved in 555 parts by weight of ion-exchange water, and the mixture is placed in a polymerization flask. The mixture is stirred gently in the polymerization flask tightly sealed and equipped with a reflux condenser under nitrogen flow, and the polymerization flask is heated to 75° C. in a water bath and kept at the same temperature.

Subsequently, a solution of 9 parts by weight of ammonium persulfate dissolved in 43 parts by weight of exchange water is added into the polymerization flask by a quantitative determination pump over a period of 20 minutes, and then, the monomer emulsion A is added drop-wise by a quantitative determination pump over a period of 200 minutes.

Then, the polymerization flask is kept at 75° C. for 3 hours while the mixture is stirred gently until completion of polymerization, to give an anionic non-crystalline vinyl resin particle dispersion (8) containing particles having a median diameter of 210 nm, a glass transition temperature of 53.5° C., a weight-average molecular weight of 31,000, and a solid content of 42 wt %.

(Preparation of Crystalline Polyester Resin Particle Dispersion (9))

| | |
|---|---|
| Decylbenzenesulfonic acid: | 4.0 parts by weight |
| 1,9-Nonanediol: | 80.0 parts by weight |
| Dodecanedicarboxylic acid: | 100.0 parts by weight |

The components above are mixed in a 500-ml flask, heated to 120° C. with a mantle heater for fusion of the mixture, and kept at 80° C. for 8 hours while agitated with Three One Motor and de-aerated, to give a viscous fused material.

An aqueous solution for neutralization prepared by dissolving 1.5 parts by weight of 1N NaOH in 810 parts by weight of ion-exchange water and heated to 90° C. is added to the fused material, and the mixture is emulsified with a homogenizer (Ultra-Turrax® T50, manufactured by IKA) for 5 minutes, and then the flask is cooled with water at room temperature, to give a crystalline polysulfide ester resin particle dispersion (9) having an average particle diameter of 260 nm, a melting point of 70° C., a weight-average molecular weight of 13,000, and a solid content of 20 wt %.

(Preparation of Yellow Colorant Particle Dispersion (1))

| | |
|---|---|
| Yellow pigment (Y74, manufactured by Dainichiseika Color & Chemicals Mfg.): | 50 parts by weight |
| Anionic surfactant (Neogen R, manufactured by Dai-Ichi Kogyo Seiyaku): | 5 parts by weight |
| Ion-exchange water: | 200 parts by weight |

The components above are mixed and dissolved, and the mixture is dispersed with a homogenizer (Ultra-Turrax®, manufactured by IKA) for 5 minutes and additionally in a ultrasonic wave bath for 10 minutes, to give a yellow colorant particle dispersion (I) having an average diameter (median diameter) of 240 nm and a solid content 21.5 wt %.

(Preparation of Cyan Colorant Particle Dispersion (2))

A cyan colorant particle dispersion (2) having an average diameter (median diameter) of 190 nm and a solid content of 21.5 wt % is prepared in a similar manner to the yellow colorant particle dispersion (1), except that the yellow pigment used in preparing the yellow colorant particle dispersion (1) is replaced with a cyan pigment (copper phthalocyanine B15:3, manufactured by Dainichiseika Color & Chemicals Mfg.).

(Preparation of Magenta Colorant Particle Dispersion (3))

A magenta particle dispersion (3) having an average diameter (median diameter) of 165 nm and a solid content of 21.5 wt % is prepared in a similar manner to the yellow colorant particle dispersion (1), except that the yellow pigment used in preparing the yellow colorant particle dispersion (1) is replaced with a magenta pigment (PR122, manufactured by Dainippon Ink and Chemicals, Inc.).

(Preparation of Black Colorant Particle Dispersion (4))

A black particle dispersion (4) having an average diameter (median diameter) of 170 nm and a solid content of 21.5 wt % is prepared in a similar manner to the yellow colorant particle dispersion (1), except that the yellow pigment used in preparing the yellow colorant particle dispersion (1) is replaced with a black pigment (carbon black, manufactured by Cabot).

(Preparation of Releasing Agent Particle Dispersion)

| | |
|---|---|
| Paraffin wax (HNP9, manufactured by Nippon Seiro; melting point: 70° C.): | 50 parts by weight |
| Anionic surfactant (DowFax ®, manufactured by Dow Chemical Company): | 5 parts by weight |
| Ion-exchange water: | 200 parts by weight |

The components above are mixed, heated to 95° C., and dispersed sufficiently with a homogenizer (Ultra-Turrax® T50, manufactured by IKA), and dispersed additionally with a high-pressure-extruding homogenizer (Gaulin homogenizer, manufactured by Gaulin), to give a releasing agent particle dispersion having an average diameter (median diameter) of 180 nm and a solid content of 21.5 wt %.

Example 1

The components above are mixed and dispersed in a round stainless steel flask sufficiently with a homogenizer (Ultra-Turrax® T50, manufactured by IKA); the flask is heated to 42° C. in a heating oil bath while the mixture is stirred and kept at 42° C. for 60 minutes; and then 50 parts by weight of the non-crystalline vinyl resin particle dispersion (8) (Resin solid-matter equivalence: 21 parts by weight) is added thereto.

Then, the mixture is adjusted to pH 5.0 with an aqueous 0.5 mole/liter sodium hydroxide solution and heated to 95° C. while the mixture is stirred continuously. The pH of mixture normally falls to 5.0 or less during heating to 95° C., but is kept to more than 4.5 by additional drop-wise addition of the aqueous sodium hydroxide solution.

After reaction, the mixture is cooled, filtered, and washed thoroughly with ion-exchange water, and the resulting particles are solid-liquid separated with a Nutsche filter. The particles are then re-dispersed in 3 liters of ion-exchange water at 40° C. in a 5-liter beaker and the dispersion is agitated and washed at 300 rpm for 15 minutes. The washing operation is repeated five times; and the particles are separated with a Nutsche filter and freeze dried under vacuum for 12 hours, to give toner particles.

Analysis of the diameter of the toner particles by using a Coulter Counter® shows that the cumulative volume-average diameter $D_{50v}$ thereof is 4.5 μm and the volume-average particle distribution index GSDv 1.23. In addition, analysis of the shape with Luzex reveals that the particle is in the potato shape having a particle shape factor SF1 of 128.

1.5 parts by weight of hydrophobic silica (TS720, manufactured by Cabot) is added to 50 parts by weight of the toner particle, and the mixture is blended in a sample mill, to give an external additive toner.

Preparation of Developer

Then, a ferrite carrier having a volume-average diameter of 50 μm that is coated with polymethyl methacrylate (manufactured by Soken Chemical & Engineering Co., weight-average molecular weight: 80,000) in an amount of 1 wt % with respect to the ferrite core is prepared; the external additive toner is weighed in an amount equivalent to a toner concentration of 5 wt %; and both are agitated and blended in a ball mill for 5 minutes, to give a developer.

Evaluation of Toner

The toner is evaluated by using a test machine modified from DocuCenterColor 500 manufactured by Fuji Xerox Co., Ltd. It is a machine for oil-less fusion that is equipped with a fusing device having a tube-fusing roll made of PFA (perfluoroalkylvinylether copolymer). The toner is evaluated at a

| Preparation of toner particle | |
|---|---|
| Crystalline polysulfide ester resin particle dispersion (1): | 100 parts by weight (resin solid-matter equivalence: 20 parts by weight) |
| Noncrystalline vinyl resin particle dispersion (8): | 100 parts by weight (resin solid-matter equivalence: 42 parts by weight) |
| Yellow colorant particle dispersion (1): | 40 parts by weight (pigment solid-matter equivalence: 8.6 parts by weight) |
| Releasing agent particle dispersion: | 40 parts by weight (releasing agent solid-matter equivalence: 8.6 parts by weight) |
| Polyaluminum chloride: | 0.15 parts by weight |
| Ion-exchange water: | 300 parts by weight |

constant processing speed of 180 mm/sec. The transfer paper used is "J Coated paper" manufactured by Fuji Xerox Co., Ltd.

Various evaluation results are summarized in Table 1, together with raw toner materials, physical properties, and others. The evaluation methods and the criteria for the test items in Table 1 (and also in Table 2) are as follows:

<Evaluation of Lowest Fusing Temperature and Hot Offsetting>

The lowest fusing temperature and the hot offsetting are evaluated by fusing images while raising the fusing temperatures fi-om 80° C. to 200° C. at an interval of 5° C.

The lowest fusing temperature shown in Tables 1 and 2 is the lowest temperature at which there is no image staining generated, when the images obtained at respective fusing temperatures are rubbed with a cloth. Alternatively, the hot offsetting temperature is the lowest temperature at which there is image staining generated once again, when the images are evaluated at rising fusing temperatures.

<Image Quality>

The image quality (consistency in image quality) is evaluated, by determining and comparing the qualities of printed image between in the early stage of and after continuous 50,000-paper printing test in a summertime environment (28° C./85%) at a constant fusing temperature of 140° C. The evaluation criteria for the evaluation results shown in Tables 1 and 2 are as follows:

Initial Image Quality

G1: No change in image quality

G2: Slight change in image quality, but practically no problem

G3: Some image defects observed

G4: Significant image defect observed

Consistency in Image Quality After Printing on 50,000 Papers

G1: No change in image quality

G2: Slight change in image quality, but practically no problem

G3: Some image defects observed

G4: Significant image defect observed

<Image Storage Stability>

A sample fixed at 160° C. is cut into pieces of 5 cm square; two papers carrying a solid image are piled with respective image plane facing each other; a weight is placed thereon at a load of 80 g/cm$^2$ applied to the image plane; and the piled papers is left in a thermostatic oven at 60° C. for 48 hours and then removed and cooled. The image storage stability was evaluated by observing the solid images when the two papers carrying the solid image are peeled off from each other. The evaluation criteria for the results shown in Tables 1 and 2 are as follows:

G1: Completely no change, and no problem

G2: Slight adhesion of image planes, but practically no problem

G3: Image defect observed

G4: Removal of image or exfoliation of paper observed

<Toner Storage Stability>

20 g of non-externally added toner placed in an aluminum cup is stored in a constant-temperature chamber at 50° C. for 24 hours and removed therefrom; and the toner storage stability is evaluated by observing the caking state of the toner. The evaluation criteria for the results shown in Tables 1 and 2 are as follows:

G1: Completely no change and no problem

G2: Slight aggregation observed but practically no problem

G3: Significant aggregation of toner observed

G4: Solidification of entire toner

It is confirmed that the toner of Example 1 is superior in the oil-less fusing efficiency determined by using a PFA tube-fusing roll, has a lowest fusing temperature of 110° C., gives an image superior in fusing efficiency and a printed transfer paper separable without any resistance.

The surface glossiness of the image formed at a fusing temperature of 140° C. is favorably at 50%; both the printing and transfer efficiencies are favorable; and a favorable high-quality image without defect is obtained. There is no hot offsetting observed even at a fusing temperature of 200° C.

After the continuous 50,000-paper printing test by using the DocuCenter Color 500 in a summertime environment (28° C./85%), there is also no filming observed on the photoreceptor and a favorable image quality is preserved throughout the test. There is also no problem at all in image storage stability or toner storage stability.

Example 2

Toner particles are prepared in a similar manner to Example 1, except that the crystalline polysulfide ester resin particle dispersion (1) used in Example 1 is replaced with the crystalline polysulfide ester resin particle dispersion (2) and the yellow colorant particle dispersion (1) with the cyan colorant particle dispersion (2), and the pH during heating to 95° C. is kept at 4.0. The amounts of the respective dispersions used are shown in Table 1.

The toner particles have a cumulative volume-average diameter $D_{50v}$ of 4.40 μm and a volume-average particle distribution index GSDv of 1.21. The particle is spherical in shape with a shape factor SF1 of 122.

An external additive toner and a developer are prepared by using the toner particles in a similar manner to Example 1, and evaluated in various tests in a similar manner to Example 1. Results are summarized in Table 1.

It is confirmed that the toner of Example 2 is superior in the oil-less fusing efficiency determined by using a PFA tube-fusing roll, has a lowest fusing temperature of 100° C., gives an image superior in fusing efficiency and a printed transfer paper separable without any resistance. The surface glossiness of the image formed at a fusing temperature of 140° C. is favorable at 55%; both the printing and transfer efficiencies are favorable; and a favorable high-quality image without defect is obtained. There is no hot offsetting observed even at a fusing temperature of 200° C.

After the continuous 50,000-paper printing test in a summertime environment (28° C./85%), there is also no filming observed on the photoreceptor and a favorable image quality is preserved throughout the test. There is also no problem at all in image storage stability or toner storage stability.

Example 3

Toner particles are prepared in a similar manner to Example 1, except that the crystalline polysulfide ester resin particle dispersion (I) used in Example I is replaced with the crystalline polysulfide ester resin particle dispersion (3) and the yellow colorant particle dispersion (1) with the magenta colorant particle dispersion (3), the amount of polyaluminum chloride to 0.10 parts by weight, and the pH during heating to 95° C. is kept at 4.0. The amounts of the respective dispersions used are shown in Table 1.

The toner particles have a cumulative volume-average diameter $D_{50}$, of 4.90 μm and a volume-average particle distribution index GSDv of 1.24, and are spherical in shape with a shape factor SF1 of 116.

An external additive toner and a developer are prepared by using the toner particles in a similar manner to Example 1 and evaluated in various tests in a similar manner to Example 1. Results are summarized in Table 1.

It is confirmed that the toner of Example 3 is superior in the oil-less fusing efficiency determined by using a PFA tube-fusing roll, has a lowest fusing temperature of 105° C., gives an image superior in fusing efficiency and a printed transfer paper separable without any resistance. The surface glossiness of the image formed at a fusing temperature of 140° C. is favorable at 70%; both the printing and transfer efficiencies are favorable; and a favorable high-quality image without defect is obtained. There is no hot offsetting observed even at a fusing temperature of 200° C.

After the continuous 50,000-paper printing test performed by using the DocuCenter Color 500 in a summertime environment (28° C./85%), there is also no filming observed on the photoreceptor and a favorable image quality is preserved even oil the last paper. Although there is some adhesion in the image storage stability test, there is no problem in toner storage stability at all.

Example 4

Toner particles are prepared in a similar manner to Example 3, except that the crystalline polysulfide ester resin particle dispersion (3) used in Example 3 is replaced with the crystalline polysulfide ester resin particle dispersion (4) and the pH during heating to 95° C. is kept at 5.5. The amounts of the respective dispersions used are shown in Table 1.

The toner particles have a cumulative volume-average diameter $D_{50}$, of 3.90 μm and a volume-average particle distribution index GSDv of 1.25, and are potato shaped with a shape factor SF1 of 133.

An external additive toner and a developer are prepared by using the toner particles in a similar manner to Example 1 and evaluated in various tests in a similar manner to Example 1. Results are summarized in Table 1.

It is confirmed that the toner of Example 4 is superior in the oil-less fusing efficiency determined by using a PFA tube-fusing roll, has a lowest fusing temperature of 110° C., gives an image superior in fusing efficiency and a printed transfer paper separable without any resistance. The surface glossiness of the image formed at a fusing temperature of 140° C. is favorable at 75%; both the printing and transfer efficiencies are favorable; and a favorable high-quality image without defect is obtained. There is no hot offsetting observed even at a fusing temperature of 200° C.

After the continuous 50,000-paper printing test in a summertime environment (28° C./85%), there is also no filming observed on the photoreceptor and a favorable image quality is preserved throughout the test. There is also no problem at all in image storage stability or toner storage stability.

Example 5

Toner particles are prepared in a similar manner to Example 3, except that the crystalline polysulfide ester resin particle dispersion (3) used in Example 3 is replaced with the crystalline polysulfide ester resin particle dispersion (5) and the pH during heating to 95° C. is kept at 5.0. The amounts of the respective dispersions used are shown in Table 1.

The toner particles have a cumulative volume-average diameter $D_{50v}$ of 4.40 μm and a volume-average particle distribution index GSDv of 1.25, and are potato shaped with a shape factor SF1 of 130.

An external additive toner and a developer are prepared by using the toner particles in a similar manner to Example 1 and evaluated in various tests in a similar manner to Example 1. Results are summarized in Table 1.

It is confirmed that the toner of Example 5 is superior in the oil-less fusing efficiency determined by using a PFA tube-fusing roll, has a lowest fusing temperature of 110° C., gives an image superior in fusing efficiency and a printed transfer paper separable without any resistance. The surface glossiness of the image formed at a fusing temperature of 140° C. is favorable at 65%; both the printing and transfer efficiencies are favorable; and a favorable high-quality image without defect is obtained. There is no hot offsetting observed even at a fusing temperature of 200° C.

After the continuous 50,000-paper printing test in a summertime environment (28° C./85%), there is also no filming observed on the photoreceptor and a favorable image quality is preserved throughout the test. There is also no problem at all in image storage stability or toner storage stability.

Example 6

Toner particles are prepared in a similar manner to Example 3, except that the crystalline polysulfide ester resin particle dispersion (3) used in Example 3 is replaced with the crystalline polysulfide ester resin particle dispersion (6) and the pH during heating to 95° C. is kept at 4.0. The amounts of the respective dispersions used are shown in Table 1.

The toner particles have a cumulative volume-average diameter $D_{50}$, of 4.50 μm and a volume-average particle distribution index GSDv of 1.25, and are slightly spherical in shape with a shape factor SF1 of 125.

An external additive toner and a developer are prepared by using the toner particles in a similar manner to Example 1 and evaluated in various tests in a similar manner to Example 1. Results are summarized in Table 1.

It is confirmed that the toner of Example 6 is superior in the oil-less fusing efficiency determined by using a PFA tube-fusing roll, has a lowest fusing temperature of 100° C., gives an image superior in fusing efficiency and a printed transfer paper separable without any resistance. The surface glossiness of the image formed at a fusing temperature of 140° C. is favorable at 75%; both the printing and transfer efficiencies are favorable; and a favorable high-quality image without defect is obtained. There is no hot offsetting observed even at a fusing temperature of 200° C.

After the continuous 50,000-paper printing test in a summertime environment (28° C./85%), there is also no filming observed on the photoreceptor and a favorable image quality is preserved throughout the test. There is also no problem at all in image storage stability or toner storage stability.

Example 7

Toner particles are obtained in a similar manner to Example 1, except that all resin particle dispersions including the addition used in Example 1 is replaced with the crystalline polysulfide ester resin particle dispersion (1) and the cyan colorant particle dispersion (2) is used as the colorant particle dispersion. The amounts of the respective dispersions used are shown in Table 1.

The toner particles have a cumulative volume-average diameter $D_{50}$, of 4.90 μm and a volume-average particle distribution index GSDv of 1.25, and are slightly spherical in shape with a shape factor SF1 of 115.

An external additive toner and a developer are prepared by using the toner particles in a similar manner to Example 1 and evaluated in various tests in a similar manner to Example 1. Results are summarized in Table 1.

It is confirmed that the toner of Example 7 is superior in the oil-less fusing efficiency determined by using a PFA tube-fusing roll, has a lowest fusing temperature of 95° C., gives an image superior in fusing efficiency and a printed transfer paper separable without any resistance. The surface glossiness of the image formed at a fusing temperature of 140° C. is favorable at 80%; both the printing and transfer efficiencies are favorable; and a favorable high-quality image without defect is obtained. Although there is hot offsetting at a fusing temperature of 180° C., there is almost no problem practically.

After the continuous 50,000-paper printing test in a summertime environment (28° C./85%), there is slight filming on the photoreceptor, but there is practically no problem in the consistence in image quality. There are slight image adhesion and toner aggregation in the image and toner storage stability tests, but these are at a level practically without problem.

Example 8

| | |
|---|---|
| Dodecylbenzenesulfonic acid: | 4.0 parts by weight |
| 1,9-Nonanediol: | 90.0 parts by weight |
| 3,3'-Thiodipropionic acid: | 100.0 parts by weight |

The components above are mixed in a 500-ml flask, heated to 120° C. with a mantle heater for fusion of the mixture, and kept at 80° C. for 8 hours while the mixture is stirred with a Three One Motor under vacuum, to give a viscous fused material.

An aqueous solution for neutralization prepared by dissolving 10 parts by weight of 1N NaOH in 200 parts by weight of ion-exchange water and heated to 90° C. is added to the flask containing the fused material; the mixture is emulsified for 5 minutes by using a homogenizer (Ultra-Turrax® T50, manufactured by IKA); and the flask is cooled with water at room temperature. Then, the mixture is salted out with sodium chloride; the aggregate resin is separated from water by filtration through a filter paper under reduced pressure, washed with ion-exchange water, and dried with hot air, to give a crystalline polysulfide ester resin (A). The resin has a melting point of 72° C.

| | |
|---|---|
| Propylene oxide adduct of bisphenol A (2.2 mole): | 77.4 parts by weight |
| Ethylene oxide adduct of bisphenol A (2.2 mole): | 33.2 parts by weight |
| Terephthalic acid: | 60.2 parts by weight |
| Trimellitic anhydride: | 17.2 parts by weight |
| Dodecenylsuccinic anhydride: | 12.2 parts by weight |
| Di-n-butyltin oxide: | 0.4 parts by weight |

The materials above are placed in a stainless steel flask equipped with a thermometer, a stainless steel stirring blade, a falling film condenser and a nitrogen-supplying tube, heated to 230° C. with a mantle heater, and allowed to react for 8 hours while stirred under a reduced pressure and a nitrogen stream, to give a non-crystalline polyester resin (B) having a glass transition temperature of 64° C. and a weight-average molecular weight of 15,000.

| | |
|---|---|
| Crystalline polysulfide ester resin (A): | 20 parts by weight |
| Noncrystalline polyester resin (B): | 68 parts by weight |
| Polyethylene wax (Polywax ® 725, manufactured by Toyo-Petrolite, DSG endothermic peak: 102° C.): | 7 parts by weight |

Five parts by weight of a pigment, cyan pigment (C.I. pigment blue 15:3), is blended with the components above. The pigment was previously subjected to a flushing treatment with the polyester resin (B).

After preliminary mixing, the mixture thus obtained is kneaded in an extruder and pulverized in a jet mill. The resulting powder is classified in a Coanda grit classifier into fractions in different colors.

The toner particles have a cumulative volume-average diameter $D_{50}$, of 4.95 μm and a volume-average particle size distribution index GSDv of 1.29 and are amorphous in shape with a shape factor SF1 of 145.

An external additive toner and a developer are prepared by using the toner particles in a similar manner to Example I and evaluated in various tests in a similar manner to Example 1. Results are summarized in Table 2.

It is confirmed that the toner of Example 8 is superior in the oil-less fusing efficiency determined by using a PFA tube-fusing roll, has a lowest fusing temperature of 115° C., gives an image superior in fusing efficiency and a printed transfer paper separable without any resistance. The surface glossiness of the image formed at a fusing temperature of 140° C. is favorable at 55%; both the printing and transfer efficiencies are favorable; and a favorable high-quality image without defect is obtained. Although there is some hot offsetting at a fusing temperature of 175° C., it is at a level almost without problem.

After the continuous 50,000-paper printing test in a summertime environment (28° C./85%), there is slight filming on the photoreceptor, but there is practically no problem in the consistence in image quality. There are slight image adhesion and toner aggregation in the image and toner storage stability tests, but these are at a level practically without problem.

Example 9

Toner particles are prepared in a similar manner to Example 1, except that no amorphous resin is used and the crystalline polysulfide ester crystalline resin dispersion (1) is used instead in Example 1. The amounts of the respective dispersions used are shown in Table 1.

The toner particles have a cumulative volume-average diameter $D_{50}$, of 4.80 μm and a volume-average particle distribution index GSDv of 1.25 and are potato shaped with a shape factor SF1 of 126.

An external additive toner and a developer are prepared by using the toner particles in a similar manner to Example 1 and evaluated in various tests in a similar manner to Example 1. Results are summarized in Table 1.

It is confirmed that the toner of Example 9 is superior in the oil-less fusing efficiency determined by using a PFA tube-fusing roll, has a lowest fusing temperature of 105° C., gives an image superior in fusing efficiency and a printed transfer paper separable without any resistance. The surface glossiness of the image formed at a fusing temperature of 140° C. is favorable at 80%; both the printing and transfer efficiencies are favorable; and a favorable high-quality image without defect is obtained. There is hot offsetting observed at a fusing temperature of 190° C., but it is not practically problemsome.

After the continuous 50,000-paper printing test in a summertime environment (28° C./85%), there is slight filming on the photoreceptor and depletion of image from the start, but there is no practical problem in the consistence in image quality. There are slight image adhesion and toner aggregation in the image and toner storage stability tests, but these are at a level practically without problem.

Comparative Example 1

Toner particles are prepared in a similar manner to Example 9, except that the crystalline polyester resin dispersion (9) is used replacing the crystalline resin dispersion of Example 9. The amounts of the respective dispersions used are shown in Table 1.

The toner particles have a cumulative volume-average diameter $D_{50}$, of 4.30 μm and a volume-average particle distribution index GSDv of 1.24 and are potato shaped with a shape factor SF1 of 129.

An external additive toner and a developer are prepared by using the toner particles in a similar manner to Example 1 and evaluated in various tests in a similar manner to Example 1. Results are summarized in Table 1.

The toner of Comparative Example 1 is superior in the oil-less fusing efficiency determined by using a PFA tube-fusing roll, but has a higher lowest fusing temperature of 125° C. It is confirmed that the image has a sufficient fusing efficiency and the printed transfer paper is separated without any resistance. The surface glossiness of the image formed at a fusing temperature of 140° C. is slightly lower at 40%. Both the printing and transfer efficiencies are favorable, and a favorable high-quality image without defect is obtained. There is no hot offsetting observed even at a fusing temperature of 200° C.

After the continuous 50,000-paper printing test in a summertime environment (28° C./85%), there is slight filming on the photoreceptor and depletion of image from the start, but there is no practical problem in the consistence in image quality. There are slight image adhesion and toner aggregation in the image and toner storage stability tests, but these are at a level practically without problem.

Comparative Example 2

Toner particles are prepared in a similar manner to Example 1, except that the crystalline polyester resin dispersion (9) is used replacing the crystalline resin dispersion of Example 1. The amounts of the respective dispersions used are shown in Table 1.

The toner particles have a cumulative volume-average diameter $D_{50}$, of 4.50 μm and a volume-average particle distribution index GSDv of 1.22 and are potato shaped with shape factor SF1 of 139.

An external additive toner and a developer are prepared by using the toner particles in a similar manner to Example 1 and evaluated in various tests in a similar manner to Example 1. Results are summarized in Table 1.

The toner of Comparative Example 2 is superior in the oil-less fusing efficiency determined by using a PFA tube-fusing roll, but has a higher lowest fusing temperature of 130° C. It is confirmed that the image has a sufficient fusing efficiency and the printed transfer paper is separated without any resistance. The surface glossiness of the image formed at a fusing temperature of 140° C. is slightly lower at 35%. Both the printing and transfer efficiencies are favorable, and a favorable high-quality image without defect is obtained. There is no hot offsetting observed even at a fusing temperature of 200° C.

After the continuous 50,000-paper printing test in a summertime environment (28° C./85%), there is also no filming observed on the photoreceptor and a favorable image quality is preserved throughout the test. There is no problem at all in image storage stability or toner storage stability.

Comparative Example 3

Toner particles are prepared in a similar manner to Example 7, except that the crystalline polyester resin dispersion (9) is used replacing the crystalline resin dispersion of Example 7. The amounts of the respective dispersions used are shown in Table 1.

The toner particles have a cumulative volume-average diameter $D_{50}$, of 4.80 μm and a volume-average particle distribution index GSDv of 1.23 and are spherical in shape with a shape factor SF1 of 120.

An external additive toner and a developer are prepared by using the toner particles in a similar manner to Example 1 and evaluated in various tests in a similar manner to Example 1. Results are summarized in Table 1.

The toner of Comparative Example 1 is superior in the oil-less fusing efficiency determined by using a PFA tube-fusing roll, but has a higher lowest fusing temperature of 120° C. It is confirmed that the image has a sufficient fusing efficiency and the printed transfer paper is separated without any resistance. The surface glossiness of the image formed at a fusing temperature of 140° C. is slightly lower at 45%. Both the printing and transfer efficiencies are favorable, and a favorable high-quality image without defect is obtained. There is slight hot offsetting observed at a fusing temperature of 190° C.

After the continuous 50,000-paper printing test in a summertime environment (28° C./85%), there is slight filming on the photoreceptor in the final period of the test. There is no problem in image storage stability but some aggregation in the toner storage stability test but at a level without problem.

Comparative Example 4

| | |
|---|---|
| Dodecylbenzenesulfonic acid: | 4.0 parts by weight |
| 1,9-Nonanediol: | 80.0 parts by weight |
| 1,10-Decamethylenedicarboxylic acid: | 100.0 parts by weight |

The components above are mixed in a 500-ml flask, heated to 120° C. with a mantle heater for fusion of the mixture, and kept at 80° C. for 8 hours while stirred with a Three One Motor, to give a viscous fused material.

An aqueous solution for neutralization prepared by dissolving 10 parts by weight of 1N NaOH in 200 parts by weight of ion-exchange water and heated to 90° C. is added to the flask containing the fused material; the mixture is emulsified for 5 minutes by using a homogenizer (Ultra-Turrax® T50, manufactured by IKA); and the flask is cooled with water at room temperature. Then the mixture is salted out with sodium chloride; the aggregate resin is separated from water by filtration through a filter paper under reduced pressure, washed with ion-exchange water, and dried with hot air, to give a crystalline polysulfide ester resin (C). The resin has a melting point of 72° C.

Then, toner particles are prepared in a similar manner to Example 8, except that the crystalline polyester resin dispersion (C) is used replacing the crystalline resin dispersion of Example 8.

The toner particles have a cumulative volume-average diameter $D_{50}$, of 4.80 μm and a volume-average particle distribution index GSDv of 1.25 and are amorphous in shape with a shape factor SF1 of 145.

An external additive toner and a developer are prepared by using the toner particles in a similar manner to Example 1 and evaluated in various tests in a similar manner to Example 1. Results are summarized in Table 1.

The toner of Comparative Example 4 is superior in the oil-less fusing efficiency determined by using a PFA tube-fusing roll, but has a higher lowest fusing temperature of 130° C. It is confirmed that the image has a sufficient fusing efficiency and the printed transfer paper is separated without any resistance. The surface glossiness of the image formed at a fusing temperature of 140° C. is slightly lower at 45%. Both the printing and transfer efficiencies are favorable, and a favorable high-quality image without defect is obtained. There is slight hot offsetting observed at a fusing temperature of 180° C.

During the continuous 50,000-paper printing test in a summertime environment (28° C./85%), there is distinct filming on the photoreceptor in the final period of the test. There are some defects in the image storage stability test and aggregation in the toner storage stability test.

TABLE 1

| | | | Example 1 | Example 2 | Example 3 | Example 4 | Example 5 | Example 6 | Example 7 | Example 9 | Comparative Example 1 | Comparative Example 2 | Comparative Example 3 |
|---|---|---|---|---|---|---|---|---|---|---|---|---|---|
| Material and physical properties of toner | Crystalline resin particle dispersion | Kind | (1) | (2) | (3) | (4) | (5) | (6) | (1) | (1) | (9) | (9) | (9) |
| | | Amount (parts by weight) | 100 | 100 | 100 | 100 | 100 | 100 | 305 | 310 | 310 | 100 | 305 |
| | | Median diameter (μm) | 0.28 | 0.33 | 0.45 | 0.21 | 0.16 | 0.16 | 0.28 | 0.28 | 0.26 | 0.26 | 0.26 |
| | | Melting point (° C.) | 72 | 53 | 51 | 66 | 62 | 62 | 72 | 72 | 70 | 70 | 70 |
| | Amorphous resin particle dispersion | Kind | (8) | (8) | (7) | (7) | (7) | (7) | — | — | — | (8) | — |
| | | Amount (parts by weight) | 100 | 50 | 210 | 210 | 210 | 210 | — | — | — | 100 | — |
| | | Median diameter (μM) | 0.21 | 0.21 | 0.14 | 0.14 | 0.14 | 0.14 | — | — | — | 0.21 | — |
| | | Glass transition point (° C.) | 53.5 | 53.5 | 64 | 64 | 64 | 64 | — | — | — | 53.5 | — |
| | Additional resin particle dispersion | Kind | (8) | (8) | (7) | (7) | (7) | (7) | (1) | (8) | (8) | (8) | (9) |
| | | Amount (parts by weight) | 50 | 50 | 100 | 100 | 100 | 100 | 105 | 50 | 50 | 50 | 105 |
| | Colorant particle dispersion | Kind | (1) | (2) | (3) | (1) | (3) | (3) | (2) | (1) | (1) | (1) | (2) |
| | | Amount (parts by weight) | 40 | 40 | 40 | 40 | 40 | 40 | 40 | 40 | 40 | 40 | 40 |
| | Releasing agent particle dispersion | Amount (parts by weight) | 40 | 40 | 40 | 40 | 40 | 40 | 40 | 40 | 40 | 40 | 40 |
| Diameter and shape of toner particle | Cumulative volume-average diameter $D_{50v}$ (μm) | | 4.5 | 4.4 | 4.9 | 3.9 | 4.4 | 4.5 | 4.9 | 4.8 | 4.3 | 4.5 | 4.8 |
| | Shape factor SF1 | | 128 | 122 | 116 | 133 | 130 | 125 | 115 | 126 | 129 | 139 | 120 |
| Evaluation results | Lowest fusing temperature (° C.) | | 110 | 100 | 105 | 110 | 110 | 100 | 95 | 105 | 125 | 130 | 120 |
| | Hot offsetting temperature (° C.) | | 200 or more | 200 or more | 200 or more | 200 or more | 200 or more | 200 or more | 180 | 190 | 200 or more | 200 or more | 190 |
| | Continuous 50,000-paper printing test in summertime environment | Initial image quality | G1 | G1 | G1 | G1 | G1 | G1 | G1 | G2 | G2 | G1 | G1 |
| | | Consistency in image quality | G1 | G1 | G1 | G1 | G1 | G1 | G2 | G2 | G2 | G1 | G2 |
| | Image storage stability | | G1 | G1 | G2 | G1 | G1 | G1 | G2 | G2 | G2 | G1 | G1 |
| | Toner storage stability | | G1 | G1 | G1 | G1 | G1 | G1 | G2 | G2 | G2 | G1 | G2 |

TABLE 2

| | | | Example 8 | Comparative Example 4 |
|---|---|---|---|---|
| Material and physical properties of toner | Crystalline resin | Kind | (A) | (C) |
| | | Amount (parts by weight) | 20 | 20 |
| | | Melting point (° C.) | 72 | 72 |
| | Amorphous resin | Kind | (B) | (B) |
| | | Amount (parts by weight) | 68 | 68 |
| | | Glass transition point (° C.) | 64 | 64 |
| | Colorant | Amount (parts by weight) | 5 | 5 |
| | Releasing agent | Amount (parts by weight) | 7 | 7 |
| Diameter and shape of toner particle | Cumulative volume-average diameter $D_{50v}$ (μm) | | 4.95 | 4.8 |
| | Shape factor SF1 | | 145 | 145 |
| Evaluation results | Lowest fusing temperature (° C.) | | 115 | 130 |
| | Hot offsetting temperature (° C.) | | 175 | 180 |
| | Continuous 50,000-paper printing test in summertime environment | Initial image quality | G2 | G2 |
| | | Consistency in image quality | G2 | G3 |
| | Image storage stability | | G2 | G3 |
| | Toner storage stability | | G2 | G3 |

The results above indicate that the toners according to the invention employing a crystalline polysulfide ester resin are superior all in low-temperature fusing efficiency, charging properties, and storage stability at a high level and thus in reliability, and that the toner are not dependent on a particular production method or a particular combination of materials for exhibiting these characteristics and can be produced in a variety of production methods and in various combinations of materials, allowing a higher degree of freedom in toner design.

The invention will be described in more detail, with reference to Examples of using the ester compound in an embodiment of the invention.

The toners in the following Examples and Comparative Examples are prepared by the following method: The following binder resin particle dispersion, colorant particle dispersion, ester compound dispersion and releasing agent particle dispersion are prepared respectively; an inorganic metal salt polymer is added for ionic neutralization respectively to these dispersions in a predetermined amount while the dispersion is stirred, to give the aggregates of the respective particles. The pH of the mixture is adjusted from acidic to weakly alkaline by addition of an inorganic hydroxide and then, the aggregates are fused by heating to a temperature not lower than the glass transition point of the resin fine particles. Then, the aggregates are washed thoroughly, solid-liquid separated, and dried, to give a desired toner. Hereinafter, typical examples of the method of preparing respective materials and forming respective aggregate particles will be described.

(Preparation of Binder Resin Particle Dispersion 1)

| | |
|---|---|
| Ethylene glycol (manufactured by Wako Pure Chemical Industries): | 50 parts |
| Neopentylglycol (manufactured by Wako Pure Chemical Industries): | 65 parts |
| Terephthalic acid (manufactured by Wako Pure Chemical Industries): | 96 parts |

The monomers above are placed in a flask and heated to 190° C. over 1 hour, and after confirming that the reaction mixture is stirred uniformly, 1.2 parts of dibutyltin oxide is added thereto. The mixture is further heated from the same temperature to 240° C. over 6 hours while water generated is distilled off, heated at 240° C. additionally for 4 hours allowing the dehydration condensation reaction to continue, to give polyester resin having an acid value of 10.0 mgKOH/g.

Then, the resin in the molten state is fed to Cavitron® CD1010 (manufactured by Eurotec, Ltd.) at a rate of 100 g/min. A dilute ammonia water prepared by diluting reagent-grade ammonia water in ion-exchange water to a concentration of 0.37%, which is placed in an aqueous medium tank separately made available, is fed, after it is heated to 120° C. by a heat exchanger, to the Cavitron® at a rate of 0.1 liter/min, simultaneously with the polyester resin fused material, and the mixture is processed in Cavitron® at a rotor revolution of 60 Hz under an applied force of 5 kg/cm$^2$, to give binder resin fine particle dispersion 1 containing solid matter at 30%.

The weight-average molecular weight, glass transition point and volume-average diameter of the resin, as determined by the methods above, are respectively 20,000, 60° C., and 160 nm.

(Preparation of Binder Resin Particle Dispersion 2)

| | |
|---|---|
| (Oil phase) | |
| Styrene (manufactured by Wako Pure Chemical Industries): | 30 parts |
| n-Butyl acrylate (manufactured by Wako Pure Chemical Industries): | 10 parts |
| β-Carboxyethyl acrylate (manufactured by Rhodia NiCCa): | 1.3 parts |
| Dodecanethiol (manufactured by Wako Pure Chemical Industries): | 0.4 parts |
| (Aqueous phase 1) | |
| Ion-exchange water: | 17 parts |
| Anionic surfactant (DOW-FAX ®, manufactured by Dow Chemical Company): | 0.4 parts |
| (Aqueous phase 2) | |
| Ion-exchange water: | 40 parts |
| Anionic surfactant (DOW-FAX ®, manufactured by Dow Chemical Company): | 0.05 parts |
| Ammonium peroxodisulfate (manufactured by Wako Pure Chemical Industries): | 0.4 parts |

The oil phase components and the components of aqueous phase 1 are place and stirred in a flask, to give a monomer-emulsified dispersion. The components of aqueous phase 2 are placed in a reaction container, and the mixture is heated to 75° C. in an oil bath while air in the container is sufficiently substituted with nitrogen. The monomer-emulsified dispersion is added dropwise into the reaction container gradually over 3 hours, allowing the emulsion polymerization to proceed. After dropwise addition, the polymerization is continued additionally at 75° C. and terminated after 3 hours, to give a binder resin particle dispersion 2 containing solid matters at 42%.

The binder resin particles obtained have a volume-average diameter of 200 nm, a glass transition point of 56° C., and a weight-average molecular weight of 30,000.

(Preparation of Colorant Particle Dispersion)

| | |
|---|---|
| Cyan pigment (Pigment Blue 15:3, manufactured by Dainichiseika Color & Chemicals Mfg. Co., Ltd.): | 10 parts |
| Anionic surfactant (Neogen SC, manufactured by Dai-ichi Kogyo Seiyaku Co., Ltd.): | 2 parts |
| Ion-exchange water: | 80 parts |

The components above are mixed and dispersed in a high pressure-impact dispersing machine Ultimizer (HJP30006, manufactured by Sugino Machine Ltd.) for 1 hour, to give a colorant particle dispersion having a volume-average diameter of 180 nm and a solid matter of 20%.

(Preparation of Ester Compound 1)

| | |
|---|---|
| 3,3'-Thiodipropionic acid (manufactured by Wako Pure Chemical Industries): | 105 parts |
| 1,8-Octanediol (manufactured by Wako Pure Chemical Industries): | 73 parts |

The monomers above are placed in a flask and heated to 160° C. over 1 hour, and after confirming that the reaction mixture is stirred uniformly, 0.02 parts of dibutyltin oxide is added thereto. The mixture is further heated from the same temperature to 200° C. over 6 hours while water generated is distilled off, heated at 200° C. additionally for 4 hours allowing the dehydration condensation reaction to continue, and then the reaction is terminated. The solid matter obtained by solid-liquid separation of the reaction solution after cooling is dried at 40° C. under vacuum, to give an ester compound 1.

The melting point and the weight-average molecular weight of the ester compound 1 obtained, as determined by the above-described methods, are 58° C. and 10,000.

(Preparation of Ester Compound 2)

| | |
|---|---|
| 3,3'-Thiodipropionic acid (manufactured by Wako Pure Chemical Industries): | 105 parts |
| 1,10-Decanediol (manufactured by Wako Pure Chemical Industries): | 87 parts |

The monomers above are placed in a flask and heated to 160° C. over 1 hour, and after confirming that the reaction mixture is stirred uniformly, 0.02 parts of dibutyltin oxide is added thereto. The mixture is further heated from the same temperature to 200° C. over 6 hours while water generated is distilled off and additionally at 200° C. for 4 hours allowing the dehydration condensation reaction to continue, and then the reaction is terminated. The solid matter obtained by solid-liquid separation of the reaction solution after cooling is dried at 40° C. under vacuum, to give an ester compound 2.

The melting point and the weight-average molecular weight of the ester compound 2 obtained, as determined by the above-described methods, are 60° C. and 10,000.

(Preparation of Ester Compound 3)

| | |
|---|---|
| 3,3'-Thiodipropanol (manufactured by Wako Pure Chemical Industries): | 75 parts |
| Octanedicarboxylic acid (manufactured by Wako Pure Chemical Industries): | 87 parts |

The monomers above are placed in a flask and heated to 160° C. over 1 hour, and after confirming that the reaction mixture is stirred uniformly, 0.02 parts of dibutyltin oxide is added thereto. The mixture is further heated from the same temperature to 200° C. over 6 hours while water generated is distilled off and additionally at 200° C. for 4 hours allowing the dehydration condensation reaction to continue, and then the reaction is terminated. The solid matter obtained by solid-liquid separation of the reaction solution after cooling is dried at 40° C. under vacuum, to give an ester compound 3.

The melting point and the weight-average molecular weight of the ester compound 3 obtained, as determined by the above-described methods, are 65° C. and 11,000.

(Preparation of Ester Compound 4)

| | |
|---|---|
| 3,3'-Thiodipropanol (manufactured by Wako Pure Chemical Industries): | 75 parts |
| Dodecanedicarboxylic acid (manufactured by Wako Pure Chemical Industries): | 115 parts |

The monomers above are placed in a flask and heated to 160° C. over 1 hour, and after confirming that the reaction mixture is stirred uniformly, 0.02 parts of dibutyltin oxide is added thereto. The mixture is further heated from the same temperature to 200° C. over 6 hours while water generated is distilled off and additionally at 200° C. for 4 hours allowing the dehydration condensation reaction to continue, and then the reaction is terminated. The solid matter obtained by solid-liquid separation of the reaction solution after cooling is dried at 40° C. under vacuum, to give an ester compound 4.

The melting point and the weight-average molecular weight of the ester compound 4 obtained, as determined by the above-described methods, are 68° C. and 10,000.

(Preparation of Ester Compound 5)

| | |
|---|---|
| 3,3'-Dithiodipropionic acid (manufactured by Wako Pure Chemical Industries): | 121 parts |
| 1,10-Decanediol (manufactured by Wako Pure Chemical Industries): | 87 parts |

The monomers above are placed in a flask and heated to 160° C. over 1 hour, and after confirming that the reaction mixture is stirred uniformly, 0.03 parts of dibutyltin oxide is added thereto. The mixture is further heated from the same temperature to 200° C. over 6 hours while water generated is distilled off and additionally at 200° C. for 4 hours allowing the dehydration condensation reaction to continue, and then the reaction is terminated. The solid matter obtained by solid-liquid separation of the reaction solution after cooling is dried at 40° C. under vacuum, to give an ester compound 5.

The melting point and the weight-average molecular weight of the ester compound 5 obtained, as determined by the above-described methods, are 58° C. and 10,000.

(Preparation of Ester Compound 6)

| | |
|---|---|
| 3,3'-Dithiodipropanol (manufactured by Wako Pure: Chemical Industries) | 91 parts |
| Dodecanedicarboxylic acid (manufactured by Wako Pure Chemical Industries): | 115 parts |

The monomers above are placed in a flask and heated to 160° C. over 1 hour, and after confirming that the reaction mixture is stirred uniformly, 0.02 parts of dibutyltin oxide is added thereto. The mixture is further heated from the same temperature to 200° C. over 6 hours while water generated is distilled off and additionally at 200° C. for 4 hours allowing the dehydration condensation reaction to continue, and then the reaction is terminated. The solid matter obtained by solid-liquid separation of the reaction solution after cooling is dried at 40° C. under vacuum, to give an ester compound 6.

The melting point and the weight-average molecular weight of the ester compound 6 obtained, as determined by the above-described methods, are 60° C. and 9,000.

(Preparation of Ester Compound 7)

| | |
|---|---|
| 3,3'-Thiodipropionic acid (manufactured by Wako Pure Chemical Industries): | 105 parts |
| 1,9-Nonanediol (manufactured by Wako Pure Chemical Industries): | 80 parts |

The monomers above are placed in a flask and heated to 160° C. over 1 hour, and after confirming that the reaction mixture is stirred uniformly, 0.02 parts of dibutyltin oxide is added thereto. The mixture is further heated from the same temperature to 200° C. over 6 hours while water generated is distilled off and additionally at 200° C. for 4 hours allowing the dehydration condensation reaction to continue, and then the reaction is terminated. The solid matter obtained by solid-liquid separation of the reaction solution after cooling is dried at 40° C. under vacuum, to give an ester compound 7.

The melting point and the weight-average molecular weight of the ester compound 7 obtained, as determined by the above-described methods, are 68° C. and 10,000.

(Preparation of Ester Compound 8)

| | |
|---|---|
| 3,3'-Thiodipropanol (manufactured by Wako Pure Chemical Industries): | 75 parts |
| Undecanedicarboxylic acid (manufactured by Tokyo Kasei Kogyo Co.): | 108 parts |

The monomers above are placed in a flask and heated to 160° C. over 1 hour, and after confirming that the reaction mixture is stirred uniformly, 0.02 parts of dibutyltin oxide is added thereto. The mixture is further heated from the same temperature to 200° C. over 6 hours while water generated is distilled off and additionally at 200° C. for 4 hours allowing the dehydration condensation reaction to continue, and then the reaction is terminated. The solid matter obtained by solid-liquid separation of the reaction solution after cooling is dried at 40° C. under vacuum, to give an ester compound 8.

The melting point and the weight-average molecular weight of the ester compound 8 obtained, as determined by the above-described methods, are 70° C. and 11,000.

(Preparation of Ester Compound 9)

| | |
|---|---|
| 3,3'-Thiodipropionic acid (manufactured by Wako Pure Chemical Industries): | 105 parts |
| 1,8-Octanediol (manufactured by Wako Pure Chemical Industries): | 73 parts |

The monomers above are placed in a flask and heated to 160° C. over 1 hour, and after confirming that the reaction mixture is stirred uniformly, 0.02 parts of dibutyltin oxide is added thereto. The mixture is further heated from the same temperature to 200° C. over 6 hours while water generated is distilled off and additionally at 200° C. for 2 hours allowing the dehydration condensation reaction to continue, and then the reaction is terminated. The solid matter obtained by solid-liquid separation of the reaction solution after cooling is dried at 40° C. under vacuum, to give an ester compound 9.

The melting point and the weight-average molecular weight of the ester compound 9 obtained, as determined by the above-described methods, are 56° C. and 3,000.

(Preparation of Ester Compound 10)

| | |
|---|---|
| 3,3'-Thiodipropionic acid (manufactured by Wako Pure Chemical Industries): | 105 parts |
| 1,8-Octanediol (manufactured by Wako Pure Chemical Industries): | 73 parts |

The monomers above are placed in a flask and heated to 160° C. over 1 hour, and after confirming that the reaction mixture is stirred uniformly, 0.02 parts of dibutyltin oxide is added thereto. The mixture is further heated from the same temperature to 200° C. over 6 hours while water generated is distilled off and additionally at 200° C. for 8 hours allowing the dehydration condensation reaction to continue, and then the reaction is terminated. The solid matter obtained by solid-liquid separation of the reaction solution after cooling is dried at 40° C. under vacuum, to give an ester compound 10.

The melting point and the weight-average molecular weight of the ester compound 10 obtained, as determined by the above-described methods, are 59° C. and 35,000.

(Preparation of Ester Compound 11)

| | |
|---|---|
| Dodecanedicarboxylic acid (manufactured by Wako Pure Chemical Industries): | 115 parts |
| 1,12-Dodecanediol (manufactured by Ube Industries, Ltd.): | 101 parts |

The monomers above are placed in a flask and heated to 160° C. over 1 hour, and after confirming that the reaction mixture is stirred uniformly, 0.02 parts of dibutyltin oxide is added thereto. The mixture is further heated from the same temperature to 220° C. over 3 hours while water generated is distilled off and at 220° C. additionally for 6 hours allowing the dehydration condensation reaction to continue, and then the reaction is terminated. The solid matter obtained by solid-liquid separation of the reaction solution after cooling is dried at 40° C. under vacuum, to give an ester compound 11.

The melting point and the weight-average molecular weight of the ester compound 11 obtained, as determined by the above-described methods, are 82° C. and 2,000.

(Preparation of Ester Compound 12)

| | |
|---|---|
| Octanedicarboxylic acid (manufactured by Wako Pure Chemical Industries): | 87 parts |
| 1,10-Decanediol (manufactured by Wako Pure Chemical Industries, Ltd.): | 87 parts |

The monomers above are placed in a flask and heated to 160° C. over 1 hour, and after confirming that the reaction mixture is stirred uniformly, 0.02 parts of dibutyltin oxide is added thereto. The mixture is further heated from the same temperature to 190° C. over 3 hours while water generated is distilled off and at 190° C. additionally for 4 hours allowing the dehydration condensation reaction to continue, and then the reaction is terminated. The solid matter obtained by solid-liquid separation of the reaction solution after cooling is dried at 40° C. under vacuum, to give an ester compound 12.

The melting point and the weight-average molecular weight of the ester compound 12 obtained, as determined by the above-described methods, are 68° C. and 2,000.

(Preparation of Ester Compound Dispersion 1)

| | |
|---|---|
| Ester compound 1: | 50 parts |
| Anionic surfactant (Neogen SC, manufactured by Dai-ichi Kogyo Seiyaku Co., Ltd.): | 2 parts |
| Ion-exchange water: | 200 parts |

The components are dispersed sufficiently with Ultra-Turrax® T50 manufactured by IKE while heated to 120° C., and then dispersed by using a high-pressure-extruding homogenizer, until the particles therein have a volume-average diameter of 180 nm, to give a binder resin particle dispersion 1 containing solid matter in an amount of 20%.

(Preparation of Ester Compound Dispersions 2 to 12)

Ester compound dispersions 2 to 12 are prepared in a similar manner, respectively by using ester compounds 2 to 12 replacing the ester compound 1. The volume-average diameter of the dispersion oil in each dispersion is 180 nm and the solid matter is contained in an amount of 20%.

(Preparation of Releasing Agent Particle Dispersion)

| | |
|---|---|
| Paraffin wax (HNP-9, manufactured by Japan Seiro Co., Ltd.): | 50 parts |
| Anionic surfactant (Neogen SC, manufactured by Dai-ichi Kogyo Seiyaku Co., Ltd.): | 2 parts |
| Ion-exchange water: | 200 parts |

The components are dispersed sufficiently with Ultra-Turrax® T50 manufactured by IKE while heated to 120° C., and then dispersed by using a high-pressure-extruding homogenizer, until the particles therein have a volume-average diameter of 200 nm, and solid matter in an amount of 20%.

Example 11

(Preparation of Toner 11)

| | |
|---|---|
| Binder resin particle dispersion 1: | 150 parts |
| Colorant particle dispersion: | 20 parts |
| Ester compound dispersion 1: | 45 parts |

-continued

| | |
|---|---|
| Releasing agent particle dispersion: | 25 parts |
| Polyaluminum chloride: | 0.4 parts |
| Ion-exchange water: | 100 parts |

The components above are mixed and dispersed thoroughly in a round stainless steel flask by using Ultra-Turrax® T50 manufactured by IKE and heated to 48° C. in a heating oil while the mixture is stirred. The mixture is left at 48° C. for 60 minutes, and 70 parts of the same binder resin particle dispersion 1 is added gradually (additionally).

Then, the mixture is adjusted to pH 8.0 by addition of an aqueous 0.5 mol/L sodium hydroxide solution (pH adjustment), and after the stainless steel flask is sealed tightly and the seal for the agitating axis is changed to magnetic seal, the mixture is heated to 94° C. and kept at the same temperature for 3 hours while stirred. After reaction, the mixture is cooled at a cooling rate of 2° C./min, and the particles obtained are filtered, washed thoroughly with water, and solid-liquid separated by Nutsche filtration under reduced pressure. The particles are resuspended in 3 L of ion-exchange water at 30° C., and stirred and washed at 300 rpm for 15 minutes. The washing operation is repeated additionally six times, and when the pH of the filtrate becomes 7.54 and the conductivity thereof 6.5 μS/cm, the particles are solid-liquid separated by Nutsche filtration under reduced pressure by using a No. 5A filter paper, and dried under vacuum continuously for 12 hours, to give a toner.

The volume-average diameter $D_{50v}$ of the toner 1, as determined by the Coulter Counter® TA-II according to the method above, is 5.5 μm, and the volume-average particle distribution index GSDv is 1.22. Silica ($SiO_2$) fine particles surface-hydrophobilized with hexamethyldisilazane having a primary particle average diameter of 40 nm and metatitanic acid compound fine particles of having an average primary-particle diameter of 20 nm prepared in the reaction between metatitanic acid and isobutyltrimethoxylsilane are added to the toner respectively in an amount of coating the surface of the coloring particles at a coating rate of 40%, and the mixture is blended in a Henschel Mixer, to give a toner for developing electrostatic latent image 11.

<<Evaluation>>

Image Intensity (Abrasion Test)

The image intensity of the toner prepared is determined in the following abrasion test.

The test is performed by printing a paint image of 5×5 cm in size on J paper manufactured by Fuji Xerox Co., Ltd. at a toner load amount adjusted to 1.2 g/m$^2$, by using a DocuCenter Color 400 (manufactured by Fuji Xerox Co., Ltd.). The image is then fixed under the conditions of a nip width of 6.5 mm and a fusing speed of 90 mm/sec by using an external fusing device having no oil-supplying unit. The fusing temperature is controlled, based on the surface temperature of the fusing roll, which is set to 100° C.

Then, the image obtained is placed in a surface smoothness analyzer Tribogear 14DR manufactured by Shinto Scientific Co., and is subjected to an abrasion test, by using a 30-mm planer identer as measurement jig and connecting a cotton shirting No. 3 to the planer identer under the condition of a vertical load of 2,000 g and a reciprocation of 10 times. The results are classified into four groups: G1: No transfer on cotton shirting No. 3, G2: Some transfer of color, G3: Distinct transfer of color, and G4: Significant transfer of color and defect in image.

The entire test above, from printing to abrasion test, is performed in an environment of 30° C. and 88% RH.

Fusing Efficiency (Bending Test)

The fusing efficiency of the toner prepared is evaluated by the image defect at a fusing temperature of 90° C. The test is performed by printing an image at a toner load of 0.6 g/m$^2$ by using DocuCenter Color 400 (manufactured by Fuji Xerox Co., Ltd.) and fusing the image under the condition of a nip width of 6.5 mm and a fusing speed of 90 mm/sec by using an external fusing device having no oil-supplying unit. The fusing temperature is controlled, based on the surface temperature of the fusing roll, which is set to 90° C.

The paper carrying a solid fixed image of 25 mm×25 mm in size is folded by using a weight under a particular load, and the results are classified into three groups: G1: No image defect in the region, G2: Slight linear defect in the region, and G3: Distinct defect observable in the folded region.

Fusing Efficiency (Offsetting)

In the bending test above, image transfer (offsetting) by fusing is also studied, and the results are classified into three groups: G1: Without offsetting, G2: Thin offsetting observed, and G3: Offsetting observed.

Example 12

A toner 12 is prepared in a similar manner to Example 11, except that the amount of the ester compound dispersion 1 is 10 parts. After analysis, the toner 12 has a volume-average diameter $D_{50v}$ of 5.5 μm and a volume-average particle distribution index GSDv of 1.21.

The toner obtained is also analyzed in the evaluation tests similar to Example 1.

Example 13

A toner 13 is prepared in a similar manner to Example 11, except that the amount of the ester compound dispersion 1 is 80 parts. After analysis, the toner 13 has a volume-average diameter $D_{50v}$ of 5.4 μm and a volume-average particle distribution index GSDv of 1.22.

The toner obtained is also analyzed in the evaluation tests similar to Example 11.

Example 14

A toner 14 is prepared in a similar manner to Example 11, except the ester compound dispersion 1 used in Example 11 is replaced with the ester compound dispersion 2. After analysis, the toner 14 has a volume-average diameter $D_{50v}$ of 5.6 μm and a volume-average particle distribution index GSDv of 1.21.

The toner obtained is also analyzed in the evaluation tests similar to Example 11.

Example 15

A toner 15 is prepared in a similar manner to Example 11, except the ester compound dispersion 1 used in Example 11 is replaced with the ester compound dispersion 3. After analysis, the toner 15 has a volume-average diameter $D_{50v}$ of 5.4 μm and a volume-average particle distribution index GSDv of 1.22.

The toner obtained is also analyzed in the evaluation tests similar to Example 11.

Example 16

A toner 15 is prepared in a similar manner to Example 11, except the ester compound dispersion 1 used in Example 11 is replaced with the ester compound dispersion 4. After analysis, the toner 16 has a volume-average diameter $D_{50v}$ of 5.5 μm and a volume-average particle distribution index GSDv of 1.22.

The toner obtained is also analyzed in the evaluation tests similar to Example 11.

Example 17

A toner 17 is prepared in a similar manner to Example 11, except the ester compound dispersion 1 used in Example 11 is replaced with the ester compound dispersion 5. After analysis, the toner 17 has a volume-average diameter $D_{50v}$ of 5.5 μm and a volume-average particle distribution index GSDv of 1.22.

The toner obtained is also analyzed in the evaluation tests similar to Example 11.

Example 18

A toner 18 is prepared in a similar manner to Example 11, except the ester compound dispersion 1 used in Example 11 is replaced with the ester compound dispersion 6. After analysis, the toner 18 has a volume-average diameter $D_{50v}$ of 5.4 μm and a volume-average particle distribution index GSDv of 1.22.

The toner obtained is also analyzed in the evaluation tests similar to Example 11.

Example 19

A toner 19 is prepared in a similar manner to Example 11, except that the binder resin particle dispersion 1 used in Example 11 is replaced with 110 parts of the binder resin particle dispersion 2, the amount of the binder resin particle dispersion added (added additionally) after held at 48° C. for 60 minutes is 50 parts, and the pH during the pH adjustment before being heated to 94° C. and held at the same temperature for 3 hours is 6.0. After analysis, the toner 19 has a volume-average diameter $D_{50v}$ of 5.6 μm and a volume-average particle distribution index GSDv of 1.22.

The toner obtained is also analyzed in the evaluation tests similar to Example 11.

Example 20

A toner 20 is prepared in a similar manner to Example 11, except that the ester compound dispersion 1 used in Example 11 is replaced with the ester compound dispersion 7 in the same amount. After analysis, the toner 20 has a volume-average diameter $D_{50v}$ of 5.5 μm and a volume-average particle distribution index GSDv of 1.21.

The toner obtained is also analyzed in the evaluation tests similar to Example 11.

Example 21

A toner 21 is prepared in a similar manner to Example 11, except that the ester compound dispersion 1 used in Example 11 is replaced with the ester compound dispersion 8 in the same amount. After analysis, the toner 21 has a volume-average diameter $D_{50v}$ of 5.5 μm and a volume-average particle distribution index GSDv of 1.22.

The toner obtained is also analyzed in the evaluation tests similar to Example 11.

Example 22

A toner 22 is prepared in a similar manner to Example 11, except that the ester compound dispersion 1 used in Example 11 is replaced with the ester compound dispersion 9 in the same amount. After analysis, the toner 22 has a volume-average diameter $D_{50v}$ of 5.2 μm and a volume-average particle distribution index GSDv of 1.22.

The toner obtained is also analyzed in the evaluation tests similar to Example 11.

Example 23

A toner 23 is prepared in a similar manner to Example 11, except that the ester compound dispersion 1 used in Example 11 is replaced with the ester compound dispersion 10 in the same amount. After analysis, the toner 23 has a volume-average diameter $D_{50v}$ of 5.4 μm and a volume-average particle distribution index GSDv of 1.22.

The toner obtained is also analyzed in the evaluation tests similar to Example 11.

Comparative Example 24

A toner 24 is prepared in a similar manner to Example 11, except that the ester compound dispersion 1 used in Example 11 is replaced with the ester compound dispersion 11 in the same amount. After analysis, the toner 24 has a volume-average diameter $D_{50}$, of 5.6 μm and a volume-average particle distribution index GSDv of 1.22.

The toner obtained is also analyzed in the evaluation tests similar to Example 11.

Comparative Example 25

A toner 25 is prepared in a similar manner to Example 11, except that the ester compound dispersion 1 used in Example 11 is replaced with the ester compound dispersion 12 in the same amount. After analysis, the toner 25 has a volume-average diameter $D_{50v}$ of 5.4 μm and a volume-average particle distribution index GSDv of 1.22.

The toner obtained is also analyzed in the evaluation tests similar to Example 11.

The ester compounds and others used in the toners of the Examples and Comparative Examples above are summarized again in the following Table 3, and the evaluation results in the following Table 4.

TABLE 4

| | $D_{50v}$ (μm) | Image strength Abrasion test | Fusing efficiency Bending test | Fusing efficiency Offsetting |
|---|---|---|---|---|
| Example 11 | 5.5 | G1 | G1 | G1 |
| Example 12 | 5.5 | G1 | G1 | G2 |
| Example 13 | 5.4 | G2 | G1 | G1 |
| Example 14 | 5.6 | G1 | G1 | G1 |
| Example 15 | 5.4 | G1 | G1 | G1 |
| Example 16 | 5.5 | G1 | G1 | G2 |
| Example 17 | 5.5 | G1 | G1 | G1 |
| Example 18 | 5.4 | G1 | G1 | G1 |
| Example 19 | 5.6 | G2 | G2 | G2 |
| Example 20 | 5.5 | G2 | G1 | G2 |
| Example 21 | 5.5 | G2 | G2 | G1 |
| Example 22 | 5.2 | G2 | G2 | G2 |
| Example 23 | 5.4 | G2 | G2 | G2 |
| Comparative Example 24 | 5.6 | G2 | G3 | G3 |
| Comparative Example 25 | 5.4 | G2 | G2 | G3 |

What is claimed is:

1. A toner for developing an electrostatic image, comprising a crystalline resin having an ester bond and at least one of a sulfide bond or a disulfide bond in the main-chain, wherein the melting point of the crystalline resin is from 45 to 75° C.

2. The toner for developing an electrostatic image of claim 1, further comprising an amorphous resin.

3. The toner for developing an electrostatic image of claim 2, wherein the crystalline resin is contained in an amount in the range of 5 to 30 wt% with respect to the amorphous resin.

4. The toner for developing an electrostatic image of claim 2, wherein the amorphous resin has a glass transition temperature of from 50 to 75° C.

5. The toner for developing an electrostatic image of claim 1, wherein the toner has a cumulative volume-average particle diameter $D_{50V}$ in a range of 3.0 to 5.0 μm.

6. The toner for developing an electrostatic image of claim 1, prepared in an aggregation step of preparing aggregate particles by aggregating raw particles in a raw material dis-

TABLE 3

| | | | Ester compound | | | | | | |
|---|---|---|---|---|---|---|---|---|---|
| | | | | Melting | Weight-average | Dicarboxylic acid | | Dialcohol | |
| | Toner | Binder resin | Compound | point (° C.) | molecular weight | Number of carbons | Sulfur atom | Number of carbons | Sulfur atom |
| Example 11 | Toner 11 | Binder resin 1 | Compound 1 | 58 | 10,000 | 6 | Present | 8 | Absent |
| Example 12 | Toner 12 | Binder resin 1 | Compound 1 | 58 | 10,000 | 6 | Present | 8 | Absent |
| Example 13 | Toner 13 | Binder resin 1 | Compound 1 | 58 | 10,000 | 6 | Present | 8 | Absent |
| Example 14 | Toner 14 | Binder resin 1 | Compound 2 | 60 | 10,000 | 6 | Present | 10 | Absent |
| Example 15 | Toner 15 | Binder resin 1 | Compound 3 | 65 | 10,000 | 8 | Absent | 6 | Present |
| Example 16 | Toner 16 | Binder resin 1 | Compound 4 | 68 | 10,000 | 12 | Absent | 6 | Present |
| Example 17 | Toner 17 | Binder resin 1 | Compound 5 | 58 | 10,000 | 6 | Present | 10 | Absent |
| Example 18 | Toner 18 | Binder resin 1 | Compound 6 | 60 | 9,000 | 12 | Absent | 6 | Present |
| Example 19 | Toner 19 | Binder resin 2 | Compound 1 | 58 | 10,000 | 6 | Present | 8 | Absent |
| Example 20 | Toner 20 | Binder resin 1 | Compound 7 | 68 | 10,000 | 6 | Present | 9 | Absent |
| Example 21 | Toner 21 | Binder resin 1 | Compound 8 | 70 | 11,000 | 11 | Absent | 6 | Present |
| Example 22 | Toner 22 | Binder resin 1 | Compound 9 | 56 | 3,000 | 6 | Present | 8 | Absent |
| Example 23 | Toner 23 | Binder resin 1 | Compound 10 | 59 | 35,000 | 6 | Present | 8 | Absent |
| Comparative Example 24 | Toner 24 | Binder resin 1 | Compound 11 | 82 | 2,000 | 12 | Absent | 12 | Absent |
| Comparative Example 25 | Toner 25 | Binder resin 1 | Compound 12 | 68 | 2,000 | 8 | Absent | 10 | Absent |

persion in which raw material particles containing crystalline resin particles of a crystalline resin having an ester bond and at least one of a sulfide bond or a disulfide bond in the main-chain are dissolved, and a subsequent coalescence step of heating the aggregate particles, the crystalline resin particles comprising:

(1) crystalline resin particles prepared in a polymerization step of preparing the crystalline resin by poly-condensing poly-condensation monomers in a non-aqueous medium by using a surface-active acid as a poly-condensation catalyst, and in a subsequent emulsification step of dispersing the crystalline resin obtained in the polymerization step in an aqueous medium; and/or (2) crystalline resin particles prepared in an emulsification polymerization step of preparing the crystalline resin by poly-condensing poly-condensation monomers in an aqueous medium using a surface-active acid as the poly-condensation catalyst, and dispersing the crystalline resin thus prepared in the aqueous medium.

7. The toner for developing an electrostatic image of claim 6, wherein the crystalline resin particles have median particle size in a range of 0.05 to 2.0 μm.

8. A method of producing the toner for developing and electrostatic image of claim 1, comprising:

an aggregation step of preparing aggregate particles by aggregating raw material particles in a raw material dispersion in which raw material particles containing crystalline resin particles of a crystalline resin having an ester bond and at least one of a sulfide bond or a disulfide bond in the main-chain are dissolved, and a subsequent coalescence step of heating and fusing the aggregate particles, wherein the crystalline resin particles comprise:

(1) crystalline resin particles prepared in a polymerization step of preparing the crystalline resin by poly-condensing poly-condensation monomers in a non-aqueous medium by using a surface-active acid as poly-condensation catalyst, and in a subsequent emulsification step of dispersing the crystalline resin obtained in the polymerization step in an aqueous medium; and/or (2) crystalline resin particles prepared in an emulsification polymerization step of preparing the crystalline resin by poly-condensing poly-condensation monomers in an aqueous medium by using a surface-active acid as the poly-condensation catalyst and dispersing the crystalline resin thus prepared in the aqueous medium.

9. The method of producing a toner for developing an electrostatic image of claim 8, wherein the crystalline resin particles have median particle size in a range of 0.05 to 2.0 μm.

10. A method of producing the toner for developing an electrostatic image of claim 1, the method comprising:

a polymerization step of preparing the crystalline resin by poly-condensing poly-condensation monomers in a non-aqueous medium using a surface-active acid as the poly-condensation catalyst; and an emulsification step of dispersing the crystalline resin obtained in the polymerization step in an aqueous medium.

11. A resin particle dispersion prepared by adding a base to the aqueous medium which disperses the crystalline resin produced by the method of claim 10, wherein the crystalline resin particles containing of the crystalline resin have a median particle size in a range of 0.05 to 2.0 μm.

12. A method of producing the toner for developing an electrostatic image of claim 1, the method comprising:

an emulsification polymerization step of preparing the crystalline resin by poly-condensing poly-condensation monomers in an aqueous medium using a surface-active acid as the poly-condensation catalyst, and dispersing the crystalline resin thus prepared in the aqueous medium.

13. A resin particle dispersion prepared by adding a base to the aqueous medium which disperses the crystalline resin produced by the method of claim 12, wherein the crystalline resin particles containing the crystalline resin have a median particle size in a range of 0.05 to 2.0 μm.

14. The toner according to claim 1, wherein a size distribution index GSDv of a volume average particle diameter of a toner particles is 1.30 or lower, and a shape factor SF1 of the toner particles is between 100 and 140.

15. The toner according to claim 14, wherein a toner particle has a volume average particle diameter $D_{50V}$ in a range of between 3.0 to 9.0 μm.

16. The toner according to claim 15, wherein the toner particle has a volume average particle diameter $D_{50V}$ in a range of between 3.0 to 5.0 μm.

17. The toner according to claim 14, wherein a shape factor SF1 of a toner particle is between 110 to 135.

18. An electrostatic image developer, comprising a toner for developing an electrostatic image which contains a crystalline resin having an ester bond and at least one of a sulfide bond or a disulfide bond in the main-chain, wherein the melting point of the crystalline resin is from 45 to 750° C.

* * * * *